US010918223B2

(12) United States Patent
Goodwin

(10) Patent No.: US 10,918,223 B2
(45) Date of Patent: Feb. 16, 2021

(54) CONVERTIBLE INFANT SUPPORT APPARATUS

(71) Applicant: Sleep 'N Feed, LLC, Feasterville-Trevose, PA (US)

(72) Inventor: Victoria Goodwin, Feasterville-Trevose, PA (US)

(73) Assignee: Sleep 'N Feed, LLC

( * ) Notice: Subject to any disclaimer, the term of this patent is extended or adjusted under 35 U.S.C. 154(b) by 333 days.

(21) Appl. No.: 15/983,276

(22) Filed: May 18, 2018

(65) Prior Publication Data

US 2018/0338628 A1 Nov. 29, 2018

Related U.S. Application Data

(60) Provisional application No. 62/511,028, filed on May 25, 2017, provisional application No. 62/554,809, filed on Sep. 6, 2017.

(51) Int. Cl.
*A47D 15/00* (2006.01)
*A47D 13/08* (2006.01)

(52) U.S. Cl.
CPC ..... *A47D 15/005* (2013.01); *A47D 13/083* (2013.01); *A47D 15/001* (2013.01); *A47D 15/008* (2013.01)

(58) Field of Classification Search
CPC .. A47D 15/005; A47D 15/008; A47D 13/083; A47D 15/001; A47C 16/00; A47C 27/003; A47G 9/10; A61G 7/0507
See application file for complete search history.

(56) References Cited

U.S. PATENT DOCUMENTS 2,626,407 A * 1/1953 Kurry ..... A47D 9/005 5/99.1
3,583,765 A * 6/1971 Wallis ..... A47D 5/00 5/655
3,761,975 A * 10/1973 Personett ..... A47D 5/00 5/655

(Continued)

FOREIGN PATENT DOCUMENTS

FR 2911776 A1 * 8/2008 ..... A47D 15/006

OTHER PUBLICATIONS https://www.etsy.com/listing/264772708/co-baby-sleeper-moses-basket-portable?ref=pla_similar_listing_top-2.
https://www.etsy.com/listing/226651573/co-baby-sleeper-moses-basket-nest?&utm_source=google&utm_medium=cpc&utm_campaign=shopping_us_b-home_and_living-furniture-kids_furniture&utm_custom1=6e010e3b-d1d5-4435-9c9b-0da7b33e3a57&gclid=Cj0KEQjwoqvIBRD6Is6og8qB77YBEiQAcqqHex6zBjUacCv82zN_ucPIMNVq726qrG0QQP22dprvgxMaAsd78P8HAQ.
https://www.etsy.com/listing/516262615/animal-infant-peanut-pod-portable?ref=pla_similar_listing_bot-17.

*Primary Examiner* — Eric J Kurilla
(74) *Attorney, Agent, or Firm* — The Belles Group, P.C.

(57) ABSTRACT

A convertible infant support apparatus for safely supporting an infant. The apparatus includes a base that has a front surface that may be formed of a loop fabric to facilitate attachment of a plurality of pillows thereto in a variety of different configurations. The pillows include a first plurality of pillows that can be arranged along a perimeter portion of the front surface of the base in a closed geometric shape and a second plurality of pillows that can be arranged along an intermediate portion of the front surface of the base in a closed geometric shape. The first plurality of pillows may surround the second plurality of pillows and the second plurality of pillows may surround an exposed central portion of the front surface of the base. The first and second (Continued)

pluralities of pillows may be used on the base together, separately, or in any desired combination.

14 Claims, 14 Drawing Sheets

(56) References Cited

U.S. PATENT DOCUMENTS 4,383,713 A * 5/1983 Roston ..... A47D 15/003 297/219.12
4,607,402 A * 8/1986 Pollard ..... A47C 21/08 5/425
4,788,726 A * 12/1988 Rafalko ..... A47D 5/006 5/424
4,802,244 A * 2/1989 McGrath-Saleh ..... A41B 13/06 2/69
5,035,013 A * 7/1991 Bloom ..... A47D 13/063 190/1
5,088,139 A * 2/1992 Bloom ..... A47D 13/063 190/1
5,137,333 A * 8/1992 Chee ..... A47C 7/029 297/452.21
D330,139 S * 10/1992 Bloom ..... 5/655
5,165,130 A * 11/1992 Wendling ..... A47D 13/08 5/424
5,242,338 A * 9/1993 Hartdegen, III ..... A47D 9/02 482/1
5,392,785 A * 2/1995 Donahue ..... A47D 13/08 128/873
5,448,790 A * 9/1995 Saro ..... A47C 17/045 5/427
5,519,906 A * 5/1996 Fanto-Chan ..... A47C 20/027 5/631
5,551,109 A * 9/1996 Tingley ..... A47D 13/02 128/870
5,586,351 A * 12/1996 Ive ..... B60N 2/26 5/655
D393,772 S * 4/1998 Vingino ..... 5/655
5,813,066 A * 9/1998 Gebhard ..... A47D 15/008 5/424
6,047,420 A * 4/2000 Priester, III ..... A47C 16/00 5/632
6,408,463 B1 6/2002 Palacio
6,467,840 B1 * 10/2002 Verbovszky ..... A47D 15/006 297/219.12
6,505,366 B1 * 1/2003 Lied ..... A47D 15/003 5/655
6,536,058 B1 * 3/2003 Chang ..... A47G 9/1009 5/636
6,588,036 B1 * 7/2003 Hort ..... A45F 4/06 5/413 R
7,097,243 B2 * 8/2006 Verbovszky ..... A47D 15/006 297/219.12
7,311,357 B2 * 12/2007 Gold ..... B60N 2/2812 297/219.12
7,404,219 B2 * 7/2008 Berkey ..... A47C 21/046 5/655
7,500,278 B2 3/2009 Leach
7,513,001 B1 4/2009 Leach
7,549,183 B2 6/2009 Dockendorf et al.
7,588,291 B2 * 9/2009 Gold ..... A47D 5/00 297/219.12
7,676,871 B1 * 3/2010 Leach ..... A47D 13/08 5/653
7,832,036 B2 11/2010 Littlehom et al.
7,856,688 B2 12/2010 Dockendorf
7,926,135 B1 * 4/2011 Leach ..... A47D 15/005 441/130
8,166,587 B2 5/2012 Collins
8,419,128 B1 * 4/2013 Leach ..... B60N 2/2881 297/219.12
8,458,830 B1 * 6/2013 Pierce ..... A41B 13/06 5/413 R
8,555,429 B2 * 10/2013 Leach ..... A47K 3/127 4/572.1
8,914,927 B1 12/2014 Leach
D875,420 S * 2/2020 Furuland ..... D6/390
2005/0076444 A2 * 4/2005 Houghteling ..... A47D 13/08 5/655
2005/0155155 A1 * 7/2005 Kassai ..... A47D 15/008 5/732
2005/0172408 A1 * 8/2005 Temple ..... A47G 9/10 5/633
2005/0210591 A1 * 9/2005 Mead ..... A47D 13/08 5/639
2006/0026766 A1 * 2/2006 Brewin ..... A47D 15/008 5/655
2007/0245494 A1 * 10/2007 Dockendorf ..... A47C 16/00 5/655
2007/0256242 A1 * 11/2007 Warnock ..... A61F 5/05891 5/637
2008/0040854 A1 * 2/2008 Lorentz ..... A47D 13/063 5/417
2008/0182477 A1 * 7/2008 Catelli ..... A47J 45/071 446/71
2009/0083908 A1 * 4/2009 Fry ..... A47G 9/10 5/636
2009/0151080 A1 * 6/2009 Lord ..... A47D 13/08 5/655
2009/0193589 A1 * 8/2009 Carr ..... A47D 13/08 5/655
2009/0222993 A1 * 9/2009 Villanueva ..... A47D 13/083 5/655
2009/0235459 A1 9/2009 Tidwell et al.
2011/0119833 A1 * 5/2011 Clark ..... A47D 13/083 5/655
2011/0191956 A1 * 8/2011 Rabess ..... A47D 15/008 5/424
2011/0277210 A1 * 11/2011 Hardesty ..... A47D 15/008 2/69.5
2013/0111661 A1 * 5/2013 Furuland ..... A47D 9/00 5/93.1
2018/0102039 A1 * 4/2018 Furuland ..... A61B 5/1113

* cited by examiner

CONVERTIBLE INFANT SUPPORT APPARATUS

CROSS-REFERENCE TO RELATED APPLICATIONS

The present application claims priority to U.S. Provisional Patent Application Ser. No. 62/511,028, filed May 25, 2017, and U.S. Provisional Patent Application Ser. No. 62/554,809, filed Sep. 6, 2017, the entireties of which are incorporated herein by reference.

BACKGROUND

For the first few months of life, the main activities that an infant participates in are sleeping and nursing. During this time, infants wake to feed at all hours of the day and night. This schedule is exhausting for parents, and in particular for nursing mothers. During the nighttime hours, when the infant wakes up to nurse the mother must wake up, lift the infant from its bassinet or other sleeping apparatus, and prop the infant up on a pillow for nursing. After the infant has finished nursing the mother must place the infant back in the bassinet. These steps may make it difficult for the mother and/or baby to fall back asleep because they require a significant amount of movement. Thus, a need exists for a simplified apparatus and/or system that facilitates an efficient transfer of an infant between feeding and sleeping. Furthermore, a need exists for a sleeping apparatus for infants that is portable and size-adjustable as the infant grows to extend its usable life.

BRIEF SUMMARY

The invention is directed to a convertible infant support apparatus that can be used to safely support an infant during sleeping, feeding, and awake time. The apparatus includes a base that has a front surface that may be formed of a loop fabric to facilitate attachment of a plurality of pillows thereto in a variety of different configurations. The pillows include a first plurality of pillows that can be arranged along a perimeter portion of the front surface of the base in a closed geometric shape and a second plurality of pillows that can be arranged along an intermediate portion of the front surface of the base in a closed geometric shape. The first plurality of pillows may surround the second plurality of pillows and the second plurality of pillows may surround an exposed central portion of the front surface of the base. The first and second pluralities of pillows may be used on the base together, or any of the pillows of the first and second pluralities of pillows may be used on the base to form any desired configuration with the pillows for a particular infant activity (i.e., sleeping, feeding, awake time).

In one aspect, the invention may be a convertible infant support apparatus comprising: a base having a front surface and a rear surface opposite the front surface, the front surface of the base having a perimeter portion, an intermediate portion, and a central portion, the perimeter portion surrounding the intermediate portion and the intermediate portion surrounding the central portion; a first bumper assembly detachably coupled to the base along the perimeter portion of the front surface of the base, the first bumper assembly defining a first closed geometric shape; a second bumper assembly detachably coupled to the base along the intermediate portion of the front surface of the base, the second bumper assembly defining a second closed geometric shape; and wherein the first bumper assembly surrounds the second bumper assembly and the second bumper assembly surrounds the central portion of the front surface of the base In another aspect, the invention may be a convertible infant support apparatus comprising: a base having a front surface and a rear surface opposite the front surface, the front surface of the base having a central portion and a perimeter portion that surrounds the central portion, the perimeter and central portions of the front surface of the base being formed from a loop fabric; a first plurality of pillows that are detachably coupled to the base independently from one another so that the first plurality of pillows can be coupled to the base in a first plurality of different configurations, each of the pillows of the first plurality of pillows comprising a hook fastener for detachably coupling the pillows to the front surface of the base; and wherein the first plurality of different configurations comprises a first configuration in which the first plurality of pillows are located along the perimeter portion of the front surface of the base and define a first closed geometric shape that surrounds the central portion of the front surface of the base.

In yet another aspect, the invention may be a convertible infant support apparatus comprising: a base having a front surface and a rear surface opposite the front surface, the front surface of the base having a perimeter portion, an intermediate portion, and a central portion, the perimeter portion surrounding the intermediate portion and the intermediate portion surrounding the central portion; a first plurality of pillows detachably coupled to the base independently from one another so that the first plurality of pillows can be coupled to the base in a configuration in which the first plurality of pillows are located along the perimeter portion of the front surface of the base and define a first closed geometric shape that surrounds the intermediate and central portions of the front surface of the base; and a second plurality of pillows detachably coupled to the base independently from one another so that the second plurality of pillows can be coupled to the base in a configuration in which the second plurality of pillows are located along the intermediate portion of the front surface of the base and define a second closed geometric shape that surrounds the central portion of the front surface of the base; and wherein the first closed geometric shape surrounds the second closed geometric shape.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
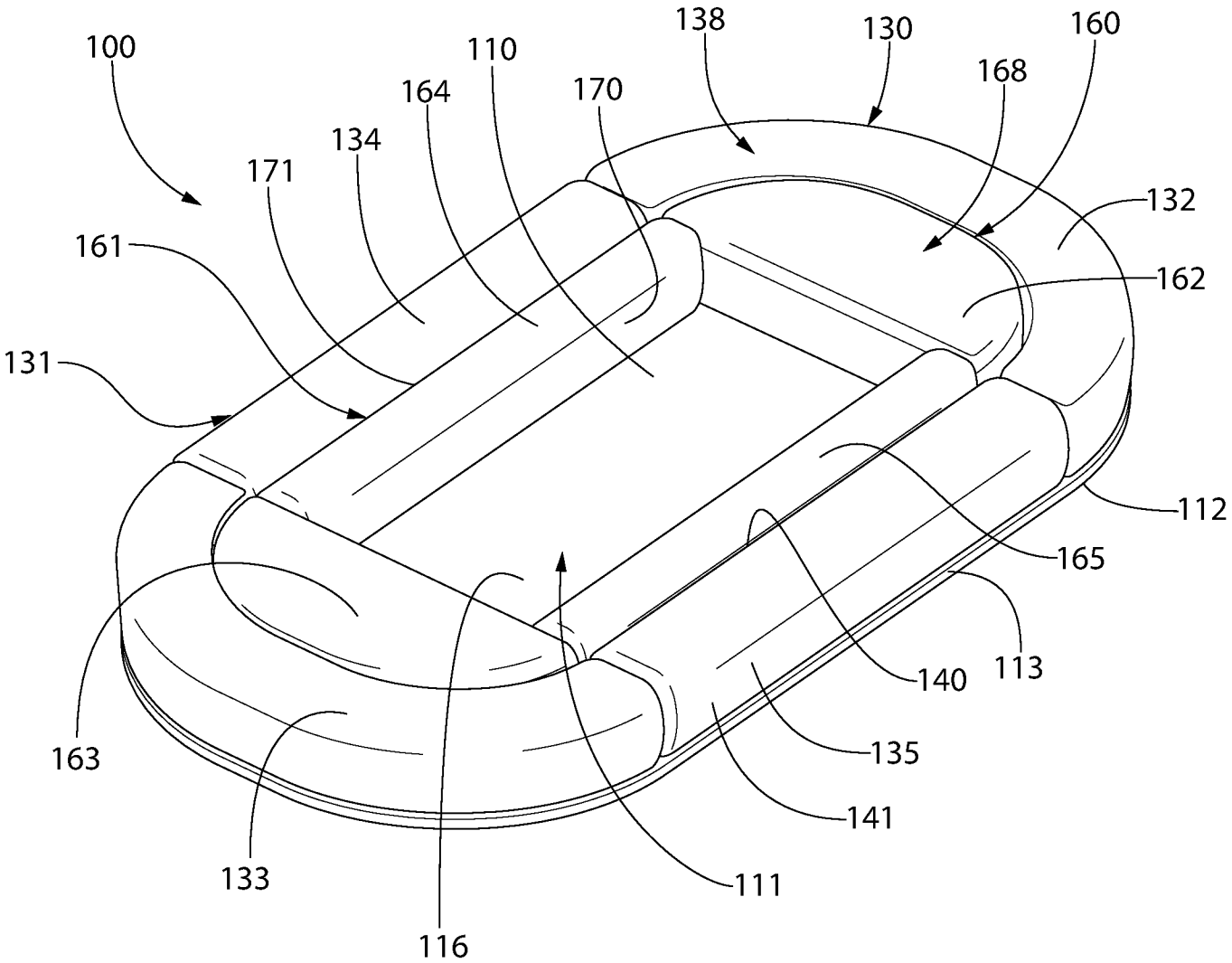
FIG. 1 is a front perspective view of a convertible infant support apparatus having a base and first and second bumper assemblies coupled to the base in accordance with an embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Referring to FIG. 1, a convertible infant support apparatus (hereinafter "the apparatus") 100 is illustrated in accordance with an embodiment of the present invention. The apparatus 100 has many uses that are relevant to the care of an infant. As used herein, the term "infant" is intended to mean a child from birth to approximately one year old, although a child older than one year could potentially continue to use the apparatus 100 depending on the size (height and weight) of the particular child. Infants are unable to sit up on their own until approximately four to seven months of age. Thus, when not being held by an adult, infants are typically lying on their back for these first few months of life. The apparatus 100 disclosed herein is suitable for safely supporting/holding an infant therein during these first few months of life. The apparatus 100 can also be used for an infant to sleep in even after the infant is able to sit up or even stand on his/her own. The apparatus 100 can be used in a plurality of different configurations to support an infant when the infant is sleeping, nursing, doing tummy time, resting, or merely lying down while awake. Specifically, the pillows of the apparatus 100 can be reconfigured as needed to provide a desired support space for an infant. Thus, the apparatus 100 can function as a nursing pillow, a traveling bassinet, a resting space, and can transform/convert into many different configurations for different feeding and rest positions. The apparatus 100 is very versatile and it can be arranged in any of a plurality of different ways that is best for the user (adult and infant).

Figure 2:
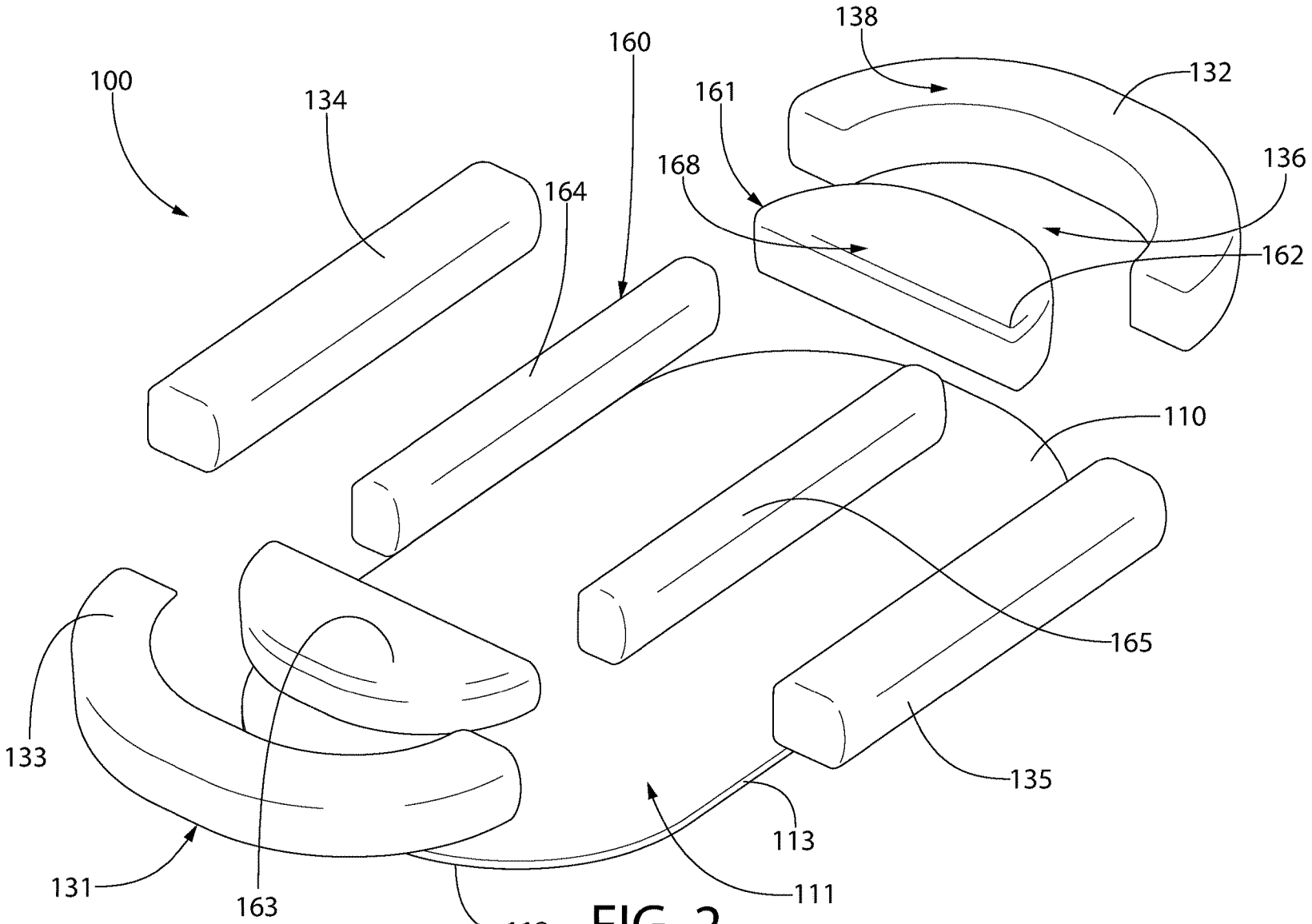
FIG. 2 is an exploded front perspective view of the convertible infant support apparatus of FIG. 1.

Referring to FIGS. 1 and 2 concurrently, the apparatus 100 generally comprises a base 110, a first bumper assembly 130, and a second bumper assembly 160. Each of the first and second bumper assemblies 130, 160, when attached to the base 110 in the configuration depicted in FIG. 1, forms a wall that surrounds a central area within which the infant may be positioned. Thus, the first and second bumper assemblies 130, 160 assist in maintaining the infant in the central area and prevents the infant (particularly one that is able to roll) from moving significant distances. Each of the first and second bumper assemblies 130, 160 are detachably coupled to the base in a variety of different configurations depending on the activity that the apparatus 100 is being used for. Some of the configurations will be discussed below with reference to FIGS. 4A-4H, although the exemplary illustrations in those figures are not exhaustive.

The base 110 comprises a front surface 111, a rear surface 112 (best shown in FIGS. 8 and 9) opposite the front surface, and an outer edge 113 extending between the front and rear surfaces 111, 112. In the exemplified embodiment, the base 110 has an oval shape. However, the invention is not to be so limited and the base 110 could have any shape as may be desired, including without limitation square, square with rounded corners, rectangular, rectangular with rounded corners, triangle, circle, or the like. Thus, the invention is not to be limited by the shape of the base 110 in all embodiments unless a specific shape is recited in the claims. The base 110 is preferably a padded mat that is comfortable for an infant to lie on. Thus, the base 110 is formed of a soft material and may have a thickness of between ½ inch and 1 inch. The base 110 may be stuffed with a soft material (i.e., foam, cotton, down/feather filling, polyester filling, or the like similar to the materials used to stuff pillows) or the base 110 may be formed from a thick soft material.

Figure 3A:
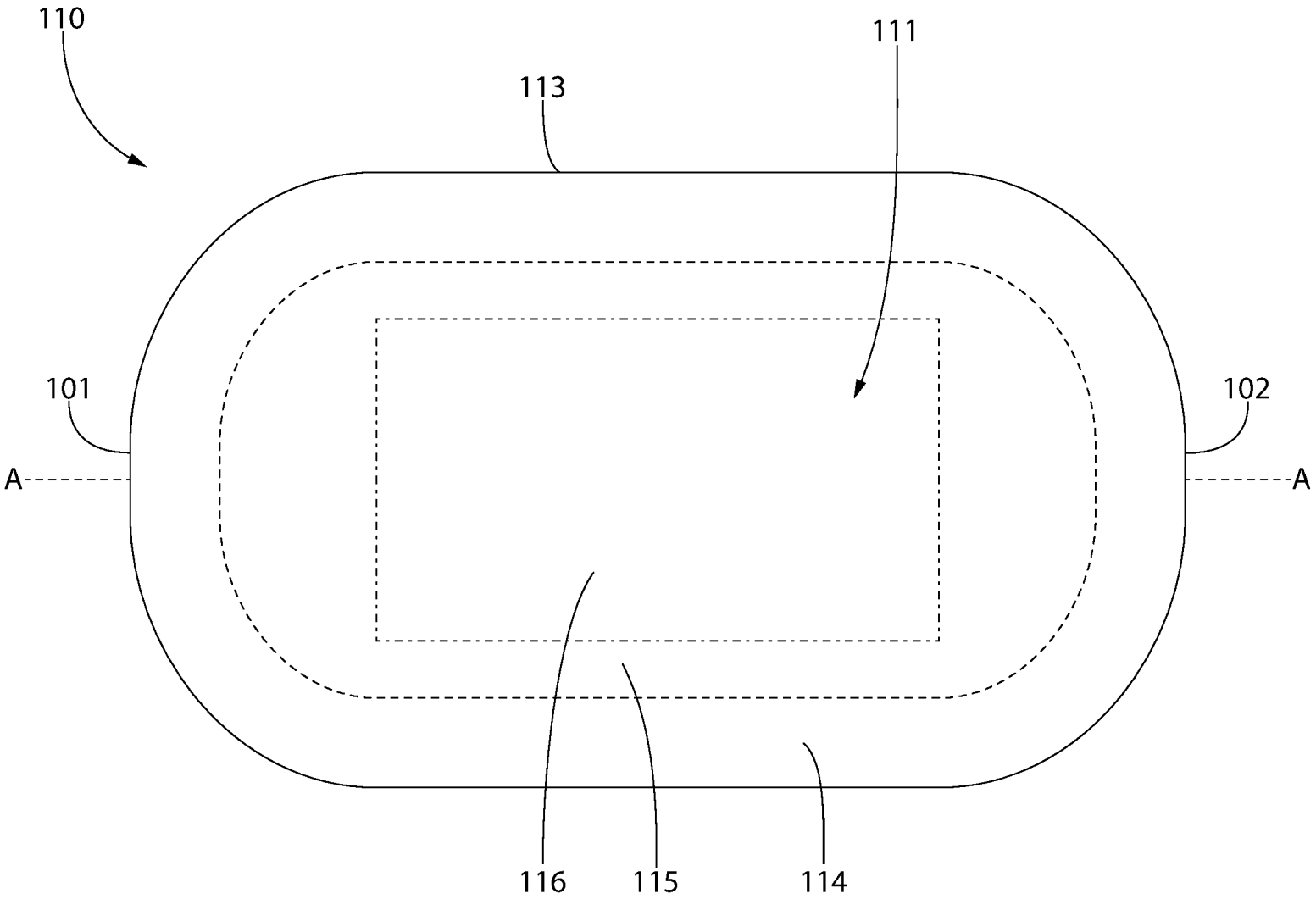
FIG. 3A is front view of the base of the convertible infant support apparatus of FIG. 1.

Referring briefly to FIG. 3A, the front surface 111 of the base 110 may be conceptually divided into a plurality of different sections or portions. The base 110 extends from a first end 101 to a second end 102 along an axis A-A. Specifically, the front surface 111 of the base 110 includes a perimeter portion 114, an intermediate portion 115, and a central portion 116. The perimeter portion 114 is the portion of the front surface 111 that is adjacent to the outer edge 113. The intermediate portion 115 of the front surface 111 is surrounded by the perimeter portion 114 of the front surface 111. Furthermore, the central portion 116 of the front surface 111 is surrounded by the intermediate portion 115 of the front surface 111. The perimeter portion 114 is generally located between the dashed line boundary and the outer edge 113, the intermediate portion 115 is generally located between the dash-dot boundary and the dashed line boundary, and the central portion 116 is bounded by the dash-dot boundary. Of course, the exact location of the boundaries and therefore the exact widths and dimensions of the various perimeter, intermediate, and central portions 114-116 are not to be limiting of the present invention and are merely illustrated in FIG. 3A as an example. The main take-away is that the perimeter portion 114 surrounds the intermediate portion 115 and the intermediate portion 115 surrounds the central portion 116. Thus, in the exemplified embodiment the perimeter, intermediate, and central portions 114-116 of the front surface 111 are in a concentric arrangement with the perimeter portion 114 having a greater outer diameter than the intermediate portion 115 and the intermediate portion 115 having a greater outer diameter than the central portion 116.

In the exemplified embodiment, the central portion 116 is illustrated as being circular in shape. However, as will be appreciated from the illustrations and description below, the central portion 116 may be rectangular in shape in certain embodiments. In some embodiments, the central portion 116 is the portion of the front surface 111 of the base 110 that is exposed and uncovered by the first and second bumper assemblies 130, 160 when the first bumper assembly 130 is coupled tot the base 110 along the perimeter portion 114 and the second bumper assembly 160 is coupled to the base 110 along the intermediate portion 114. The central portion 116 may have a length measured in a direction parallel to the axis A-A and a width measured in a direction transverse to the axis A-A. The length may be between 16-20 inches and the width may be between 4-6 inches. The central portion 116 may have an area between 60 and 120 inches$^2$, more specifically between 70 and 110 inches$^2$, and still more specifically between 80 and 100 inches$^2$. In one particular embodiment, the area of the central portion 116 may be approximately 90 inches$^2$.

In the exemplified embodiment, the front surface 111 of the base 110 is formed of a loop fabric, such as Veltex® loop fabric sold by Velcro®. Of course, other brands, styles, and types of loop fabric may be used without affecting the function of the base 110. The loop fabric may be formed from nylon, polyester, or any other desired materials and the material may be selected to achieve a desired bond strength when a hook fastener is coupled to the front surface 111 of the base 110. In certain embodiments, an entirety of the front surface 111 of the base 110 is formed of a loop fabric. Thus, each of the perimeter portion 114, the intermediate portion 115, and the central portion 116 of the front surface 111 of the base 110 may be formed of a loop fabric. This enables an item having a hook fastener thereon to be coupled to the base 110 at any location along the front surface 111 of the base 110 by simply engaging the hook fastener to the loop fabric that makes up the front surface 111 of the base 110. This will be described in more detail below with reference to the coupling of the first and second bumper assemblies 130, 160 to the base 110. Of course, in other embodiments the front surface 111 of the base 110 may be formed of a hook fabric and each of the items that are coupled to the base 110 may have a loop fastener thereon. Furthermore, although hook and loop is used in the exemplified embodiment to couple the first and second bumper assemblies 130, 160 to the base, hook and loop is merely one type of connection mechanism that may be used. Other connection mechanisms may be used including, without limitation, snaps, buttons, straps, buckles, or the like.

Although described herein with the front surface 111 of the base 110 being formed of a loop fabric, the invention is not to be so limited in all embodiments. In other embodiments, the base 110 may be formed of any desired material and hook or loop strips may be coupled to the base 110 to facilitate detachably coupling the first and second bumper assemblies 130, 160 to the base 110. In other embodiments, the base may include other connection features, such as buttons, snaps, zippers, adhesive, mechanically interlocking members, or the like that mate with similar (or opposite in the case of connection features that include "male" and "female" components) components on the first and second bumper assemblies 130, 160. Thus, the invention is not limited to the front surface 111 of the base 110 being formed of a loop fabric, although this may be preferable in some embodiments. Furthermore, the rear surface 112 of the base 110 may be formed of a different material than the front surface 111 of the base 110 because there may be no need to detachably couple any items to the rear surface 112 of the base 110.

In one exemplary embodiment, the base 110 may have a length measured in a direction parallel to the axis A-A of between 32 and 40 inches, more specifically 34 and 38 inches, and still more specifically approximately 36 inches. Furthermore, the base 110 may have a width measured in a direction transverse to the axis A-A of between 15 and 25 inches, more specifically 17 and 22 inches, and still more specifically approximately 19 inches. Of course, the dimensions of the base 110 can be greater or smaller than that which is shown and described herein in other embodiments.

Figure 3B:
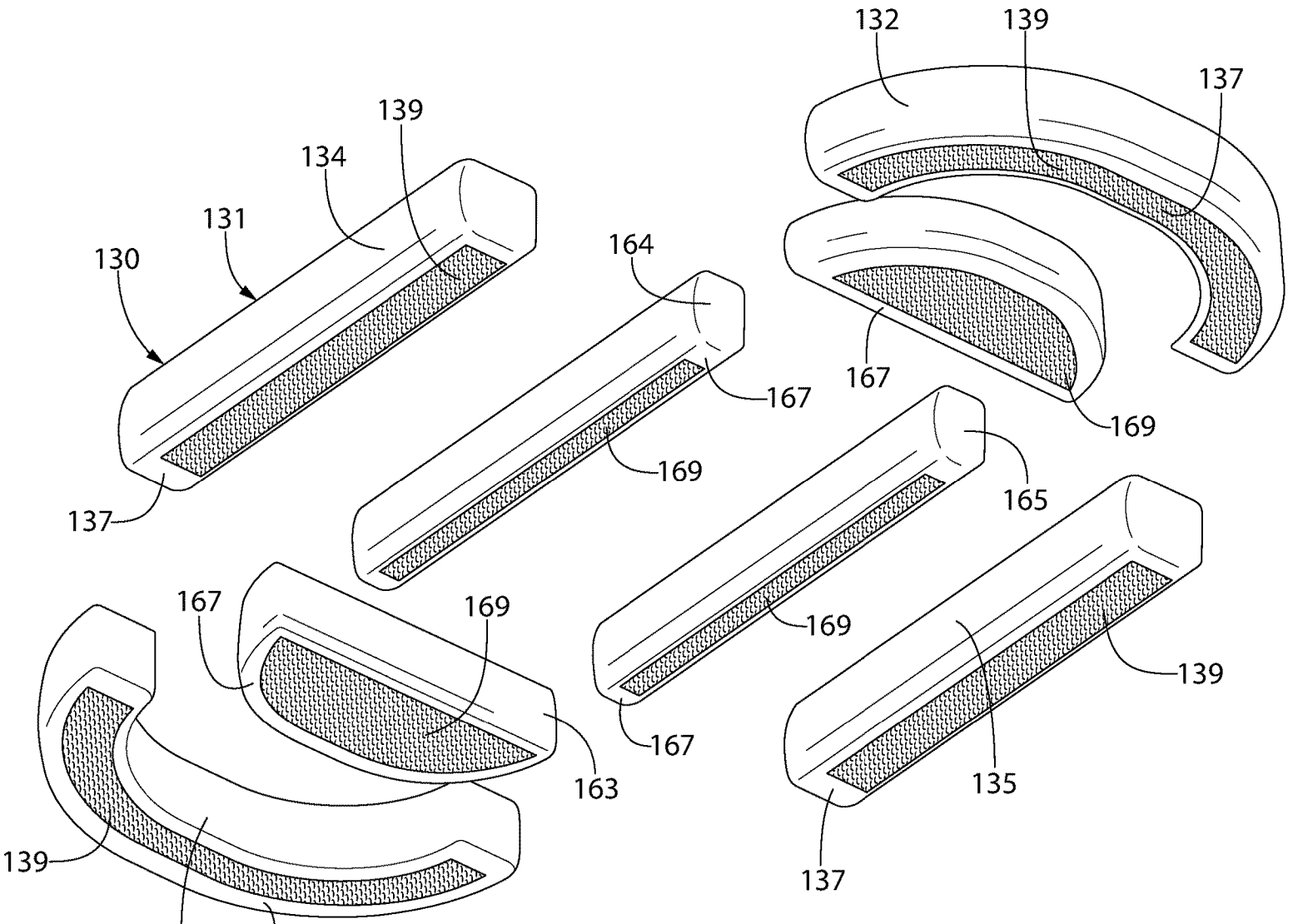
FIG. 3B is a rear exploded perspective view of the first and second bumper assemblies of the convertible infant support apparatus of FIG. 1.

Returning to FIGS. 1, 2, and 3B, the first and second bumper assemblies 130, 160 will be further described. In the exemplified embodiment, the first bumper assembly 130 comprises a first plurality of pillows 131 and the second bumper assembly 160 comprises a second plurality of pillows 161. More specifically, in the exemplified embodiment the first bumper assembly 130 comprises four pillows and the second bumper assembly 160 comprises four pillows. However, the exact number of pillows that make up the first and second bumper assemblies 130, 160 is not to be limiting of the present invention. In some embodiments, the first and second bumper assemblies 130, 160 may include a single, continuous pillow. In other embodiments, the first and second bumper assemblies 130, 160, may include two pillows, three pillows, or more than four pillows. Each of the pillows may comprise a fabric (i.e., Dintex, cotton, satin, flannel, nylon, velvet, polyester, linen, or the like) that is stuffed with a traditional pillow filling, such as for example without limitation down pillow filling, feather pillow filling, polyester fiberfill pillow filling, shredded memory foam pillow filling, buckwheat hull pillow filling, microbead pillow filling, shredded latex pillow filling, kapok pillow filling, or any other type of material capable of being used as a pillow filling.

Furthermore, although the first and second bumper assemblies 130, 160 are described herein as being formed from first and second pluralities of pillows 131, 161, the invention is not to be so limited in all embodiments. The first and second bumper assemblies 130, 160 can be formed of any material that can form a confinement or containment boundary for an infant positioned on the base 110 while not subjecting the infant to any potential injury. Thus, pillows may be desirable because they are soft, but other materials can certainly be used within the scope of the invention described herein, including rubber-like materials, foam materials, pliable or compressible materials, or the like.

The first bumper assembly 130 comprises a first arcuate end pillow 132, a second arcuate end pillow 133, a first linear side pillow 134, and second linear side pillow 135. The first and second arcuate end pillows 132, 133 are generally U-shaped with their concave sides defining a nesting region 136. The first and second linear side pillows 134, 135 are generally elongated and without curvature. In the exemplified embodiment, each of the first and second linear side pillows 134, 135 has a length measured in a direction parallel to the longitudinal axis A-A of between 19 and 2 inches and a width measured in a direction transverse to the longitudinal axis A-A of approximately 4 inches. Each of the first and second arcuate end pillows 132, 133 has a length measured in a direction transverse to the longitudinal axis A-A of between 18 and 20 inches and width measured in a direction parallel to the longitudinal axis A-A of approximately 5-7 inches.

Each of the first plurality of pillows 131 of the first bumper assembly 130 has a bottom surface 137 and a top surface 138 opposite the bottom surface 137. Furthermore, in the exemplified embodiment there is a hook fastener 139 located on the bottom surface 137 of each of the first plurality of pillows 131. The hook fasteners 139 are fabric strips that are attached (i.e., sewn, glued, taped, or the like) to the bottom surface 137 of each of the first plurality of pillows 131 that include tiny hooks that are configured to mate with the loop fabric when the hook fasteners 139 are pressed against the loop fabric of the front surface 111 of the base 110. Specifically, the hooks catch in the loops to temporarily couple the first plurality of pillows 131 to the base 110. The first plurality of pillows 131 can be detached from the base 110 by pulling or peeling the two surfaces apart with a force greater than the connection force between the hooks of the hook fasteners 139 and the loops of the loop fabric of the front surface 111 of the base 110.

In the exemplified embodiment, the hook fasteners 139 are arranged along a majority of the bottom surface 137 of each of the first plurality of pillows 131 in strips. However, the exact size, shape, length, dimensions, and placement of the hook fastener 139 on the bottom surface 137 of each of the first plurality of pillows 131 is not limiting of the present invention so long as there is a sufficient amount of the hook fastener 139 present on the bottom surface 137 of each of the first plurality of pillows 131 to facilitate coupling of each of the first plurality of pillows 131 to the front surface 111 of the base 110. In alternative embodiments, if the front surface 111 of the base 110 is not formed of a loop fabric or does not include loop strips, in alternative embodiments there may be buttons, snaps, zippers, adhesive, mechanically interlocking members, or the like on the bottom surfaces 137 of the first plurality of pillows 131 to facilitate detachable coupling of the first plurality of pillows 131 to the base 110.

The first bumper assembly 130 may be detachably coupled to the front surface 111 of the base 110 along the perimeter portion 114 of the front surface 111 of the base 110 in a configuration such that the first bumper assembly 130 defines a first closed geometric shape (as depicted in FIG. 1). Specifically, the first plurality of pillows 131 are positioned end-to-end within the perimeter portion 114 of the front surface 111 of the base 110 to form the first closed geometric shape. In the exemplified embodiment, the first closed geometric shape is an oval, a circle, or a rounded rectangle, although the invention is not to be so limited and the first closed geometric shape may change depending on the shape of the base 110 as mentioned above. The first bumper assembly 130 may be said to form a loop or a closed loop.

With the first bumper assembly 130 coupled to the front surface 111 of the base 110, the first bumper assembly 130 forms a continuous wall that is devoid of gaps that surrounds the intermediate and central portions 115, 116 of the front surface 111 of the base 110. Of course, it is possible in other embodiments that small gaps may exist between the adjacent ones of the first plurality of pillows 131 without impacting the ability of the first bumper assembly 130 to function to retain an infant within the space that it surrounds. In the exemplified embodiment, the first bumper assembly 130 has a constant height, measured from the front surface 111 of the base 110 to the top surface 138 of each of the first plurality of pillows 131, along an entirety of the first closed geometric shape.

The second bumper assembly 160 comprises a first end pillow 162, a second end pillow 163, a first linear side pillow 164, and second linear side pillow 635. The first and second end pillows 162, 163 are generally D-shaped so that they can nest within the nesting regions 136 of the first and second arcuate end pillows 132, 133 of the first plurality of pillows 131 as shown in FIG. 1. The first and second linear side pillows 164, 165 are generally elongated and without curvature. In the exemplified embodiment, each of the first and second linear side pillows 164, 165 has a length measured in a direction parallel to the longitudinal axis A-A of between 17 and 19 inches and a width measured in a direction transverse to the longitudinal axis A-A of approximately 3 inches. Each of the first and second arcuate end pillows 132, 133 has a length measured in a direction transverse to the longitudinal axis A-A of between 10 and 12 inches and width measured in a direction parallel to the longitudinal axis A-A of approximately 3-5 inches. Thus, the lengths and widths of the first and second linear side pillows 164, 165 of the second bumper assembly 160 are less than the lengths and widths of the first and second linear side pillows 134, 135 of the first bumper assembly 130. Furthermore, the lengths and widths of the first and second end pillows 162, 163 of the second bumper assembly 160 are less than the lengths and widths of the first and second arcuate end pillows 132, 133 of the first bumper assembly 130.

Each of the second plurality of pillows 161 of the second bumper assembly 160 has a bottom surface 167 and a top surface 168 opposite the bottom surface 167. Furthermore, in the exemplified embodiment there is a hook fastener 169 located on the bottom surface 167 of each of the second plurality of pillows 161. The hook fasteners 169 are fabric strips that are attached (i.e., sewn, glued, taped, or the like) to the bottom surface 167 of each of the second plurality of pillows 161 that include tiny hooks that are configured to mate with the loop fabric when the hook fasteners 169 are pressed against the loop fabric of the front surface 111 of the base 110. Specifically, the hooks catch in the loops to temporarily couple the second plurality of pillows 161 to the base 110. The second plurality of pillows 161 can be detached from the base 110 by pulling or peeling the two surfaces apart with a force greater than the connection force between the hooks of the hook fasteners 169 and the loops of the loop fabric of the front surface 111 of the base 110.

In the exemplified embodiment, the hook fasteners 139 are arranged along a majority of the bottom surface 137 of each of the first plurality of pillows 131 in strips. However, the exact size, shape, length, dimensions, and placement of the hook fastener 169 on the bottom surface 167 of each of the second plurality of pillows 161 is not limiting of the present invention so long as there is a sufficient amount of the hook fastener 169 present on the bottom surface 167 of each of the second plurality of pillows 161 to facilitate coupling of each of the second plurality of pillows 161 to the front surface 111 of the base 110. In alternative embodiments, if the front surface 111 of the base 110 is not formed of a loop fabric or does not include loop strips, in alternative embodiments there may be buttons, snaps, zippers, adhesive, mechanically interlocking members, or the like on the bottom surfaces 167 of the second plurality of pillows 161 to facilitate detachable coupling of the second plurality of pillows 161 to the base 110.

The second bumper assembly 160 may be detachably coupled to the front surface 111 of the base 110 along the intermediate portion 115 of the front surface 111 of the base 110 in a configuration such that the second bumper assembly 160 defines a second closed geometric shape. Specifically, the second plurality of pillows 161 are positioned end-to-end within the intermediate portion 115 of the front surface 111 of the base 110 to form the second closed geometric shape. In the exemplified embodiment, the second closed geometric shape is an oval, a circle, or a rounded rectangle, although the invention is not to be so limited and the second closed geometric shape may change depending on the shape of the base 110 as mentioned above. The second bumper assembly 160 may be said to form a loop or a closed loop.

With the second bumper assembly 130 coupled to the front surface 111 of the base 110, the second bumper assembly 130 forms a continuous wall that is devoid of gaps that surrounds the central portion 116 of the front surface 111 of the base 110. Of course, it is possible in other embodiments that small gaps may exist between the adjacent ones of the second plurality of pillows 161 without impacting the ability of the second bumper assembly 160 to function to retain an infant within the space that it surrounds. In the exemplified embodiment, the second bumper assembly 160 has a constant height, measured from the front surface 111 of the base 110 to the top surface 168 of each of the second plurality of pillows 161, along an entirety of the first closed geometric shape. In some embodiments, the height of the first bumper assembly 130 may be greater than the height of the second bumper assembly 160.

The first bumper assembly 130 comprises an inner surface 140 and an outer surface 141. In the exemplified embodiment, both of the inner and outer surfaces 140, 141 of the first bumper assembly 130 are oval in shape. The second bumper assembly 160 comprises an inner surface 170 and an outer surface 171. The outer surface 171 of the second bumper assembly 160 faces the inner surface 140 of the first bumper assembly 130 and the inner surface 170 of the second bumper assembly 160 faces the central portion 116 of the front surface 111 of the base 110. In the exemplified embodiment, the outer surface 171 of the second bumper assembly 160 is oval and corresponds to the shape of the inner surface 140 of the first bumper assembly 130. In the exemplified embodiment, the inner surface 170 of the second bumper assembly 160 is square or rectangular. This is due to the first and second end pillows 162, 163 being "D" shaped rather than arcuate shaped. Thus, when both of the first and second bumper assemblies 130, 160 are coupled to the base 110, the central portion 116 of the front surface 111 of the base 110 that is exposed and not covered by either of the first and second bumper assemblies 130, 160 is rectangular or square in shape. Of course, in alternative embodiments the inner surface 170 of the second bumper assembly 160 may also be oval/circular by modifying the shape of the first and second end pillows 162, 163 to be arcuate like the first and second arcuate end pillows 132, 133.

The first bumper assembly 130 may have a first minimum width measured between the inner and outer surfaces 140, 141 and the second bumper assembly 160 may have a second minimum width measured between the inner and outer surfaces 170, 171. In some embodiments, the first minimum width may be greater than the second minimum width. Moreover, in some embodiments each of the pillows of the second plurality of pillows 161 may have a volume that is less than a volume of each of the pillows of the first plurality of pillows 131. Thus, the pillows of the second plurality of pillows 161 are smaller and take up less space than the pillows of the first plurality of pillows 131.

When both of the first and second bumper assemblies 130, 160 are coupled to the base 110, the first bumper assembly 130 surrounds the second bumper assembly 160 and the second bumper assembly 160 surrounds the central portion 116 of the base 110. However, it should be appreciated that each of the pillows of the first plurality of pillows 131 and each of the pillows of the second plurality of pillows 161 is separately and independently attachable to and detachable from the base 110. Thus, each of the pillows of the first and second pluralities of pillows 131, 161 is detachable from (and attachable to) the base independently of each of the other pillows of the first and second pluralities of pillows 131, 161. Thus, while the closed geometric shape arrangement is depicted in FIG. 1, any of the pillows of the first and second pluralities of pillows 131, 161 can be removed from the base 110 to create a different configuration.

In the exemplified embodiment, the first plurality of pillows 131 are coupled to the base 110 but not to each other and the second plurality of pillows 161 are coupled to the base 110 but not to each other. Furthermore, the first plurality of pillows 131 are not connected to the second plurality of pillows 161. However, in other embodiments the first plurality of pillows 131 may include connection elements (i.e., hook-and-loop, snaps, buttons, or the like) on their end surfaces so that the first plurality of pillows 131 are coupled to each other and the second plurality of pillows 161 may include connection elements (i.e., hook-and-loop, snaps, buttons, or the like) on their end surfaces so that the second plurality of pillows 161 are coupled to each other. Furthermore, the first and second plurality of pillows 131, 161 may include connection elements (i.e., hook-and-loop, snaps, buttons, or the like) on their inner and outer surfaces to facilitate coupling the first and second plurality of pillows 131, 161 together.

Furthermore, although in FIG. 1 the first plurality of pillows 131 (i.e. the first bumper assembly 130) is located along/within the perimeter portion 114 of the front surface 111 of the base 110 and the second plurality of pillows 161 (i.e., the second bumper assembly 160) is located along/within the intermediate portion 115 of the front surface 111 of the base 110, this is merely one configuration of many that are possible. Specifically, because the entirety of the front surface 111 of the base 110 is formed from a loop fabric and because each of the pillows of the first and second pluralities of pillows 131, 161 has a hook fastener 139, 169 on its bottom surface 137, 167, each of the pillows of the first and second pluralities of pillows 131, 161 can be coupled to the base 110 at any location along the front surface 111 of the base 110.

FIGS. 4A-4H illustrate some of the many different configurations in which the first and second pluralities of pillows 131, 161 (or subsets thereof) may be coupled to the base 110. The first plurality of pillows 131 can be coupled to the base 110 in a first plurality of different configurations and the second plurality of pillows 161 can be coupled to the base 110 in a second plurality of different configurations. FIGS. 4A-4H illustrate some of the available configurations, but a user has the ability to get creative and find any other configuration that the user finds helpful for a given situation.

Figure 4A:
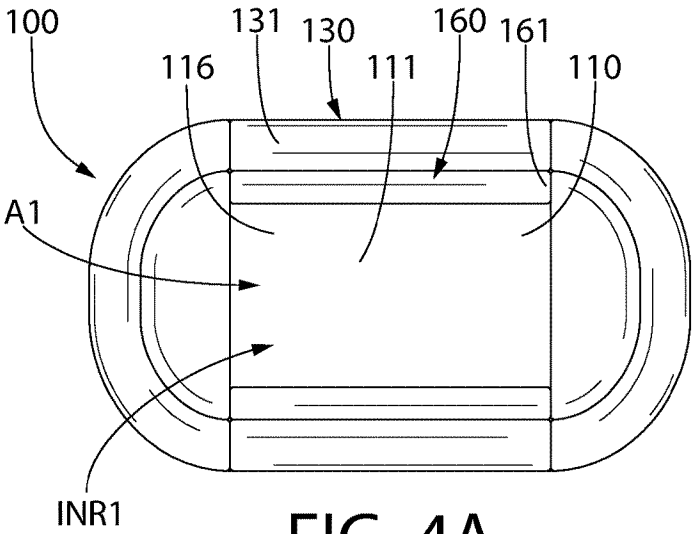
FIGS. 4A-4H are front views illustrating different configurations in which the first and second bumper assemblies can be coupled to the base.

FIG. 4A illustrates a first configuration whereby the first plurality of pillows 131 are coupled to the base 110 along the perimeter portion 114 of the front surface 111 of the base 110 and the second plurality of pillows 161 are coupled to the base 110 along the intermediate portion 115 of the front surface 111 of the base 110. The central portion 116 of the front surface 111 of the base 110 is exposed and free of any of the pillows being coupled thereto. Thus, in FIG. 4A the first and second bumper assemblies 130, 160 are in a first state in which the first and second bumper assemblies 130, 160 are in their entirety coupled to the base 110 to define a first infant nesting region INR1 having a first area A1. The first infant nesting region INR1 may have a length of approximately 18 inches (plus or minus two inches) and a width of 5 inches (plus or minus one inch). Thus, the first area A1 may be between 70 and 110 inches$^2$, between 80 and 100 inches$^2$, or between 85 and 95 inches$^2$ in some embodiments. This configuration of the first and second bumper assemblies 130, 160 (i.e., of the first and second pluralities of pillows 131, 161) is best suited for an infant from newborn age through three months because the infant nesting region INR1 is the smallest with the first and second bumper assemblies 130, 160 in this configuration.

Figure 10:
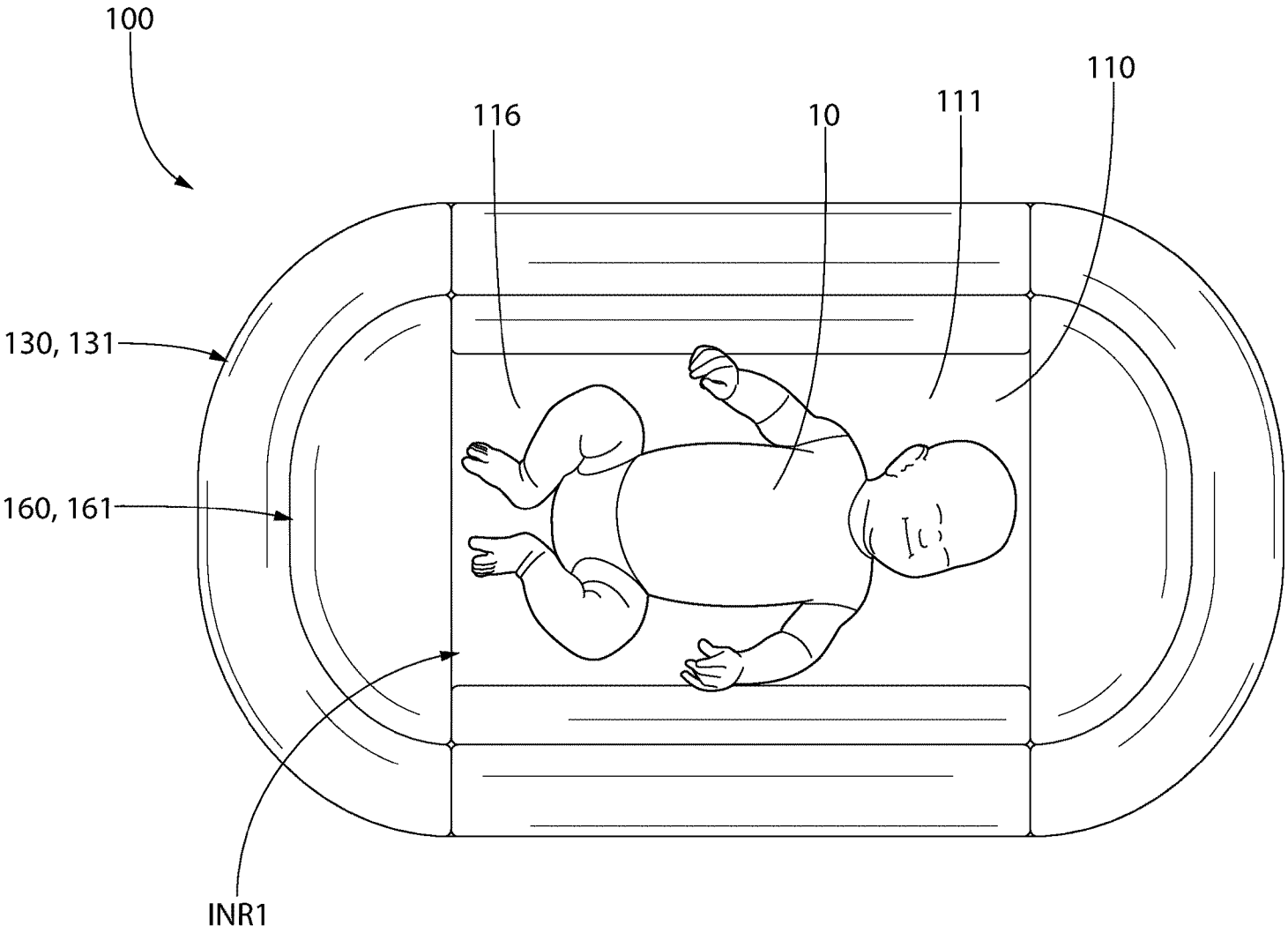
FIG. 10 is a front view of the convertible infant support apparatus in with the first and second bumper assemblies attached to the base and an infant resting on the base surrounded by the first and second bumper assemblies.

FIG. 10 illustrates the apparatus 100 with the first and second bumper assemblies 130, 160 in the first state just like in FIG. 4A, except that in FIG. 10 an infant 10 is located within the first infant nesting region INR1, which is equivalent to the central portion 116 of the front surface 111 of the base 110. As can be seen, there is plenty of space for the infant 10 in the first infant nesting region INR1. The infant 10 can sleep within the first infant nesting region INR1 with the first and second bumper assemblies 130, 160 in this state. Furthermore, the first and second bumper assemblies 130, 160 can be altered into different positions or separated from the base 110 to achieve different configurations for the first and second bumper assemblies 130, 160, as discussed more fully below.

Figure 4B:
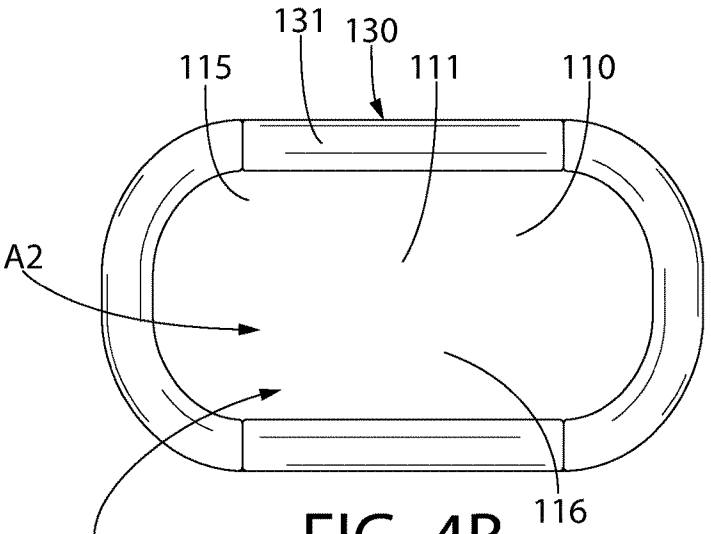

FIG. 4B illustrates a second configuration (or a second state of the first and second bumper assemblies 130, 160) whereby the first plurality of pillows 131 of the first bumper assembly 130 are all coupled to the base 110 along the perimeter portion 114 of the front surface 111 of the base 110, but where none of the second plurality of pillows 161 of the second bumper assembly 160 are coupled to the base 110. In this state, the first bumper assembly 130 defines a second infant nesting region INR2 having a second area A2. The second infant nesting region INR2 may have a length measured in a direction parallel to the axis A-A of between 24 and 28 inches and a width measured in a direction transverse to the axis A-A of between 10 and 12 inches. Thus, the second area A2 may be between 260 and 310 inches$^2$, more specifically between 270 and 300 inches$^2$, still more specifically between 280 and 290 inches$^2$, and still more specifically approximately 285 inches$^2$. The second area A2 is greater than the first area A1 because the second plurality of pillows 161 of the second bumper assembly 160 are not taking up space on the front surface 111 of the base 110. This configuration of the first and second bumper assemblies 130, 160 is best suited for an older (or larger) infant, such as one that is between nine and twelve months old, because the space on the base 110 available for placing the infant is larger.

The second bumper assembly 160 may be considered a newborn insert in some embodiments because it decreases the exposed area of the base 110 on which the infant can be placed. There is a need for the second bumper assembly 160 because even though the infant may fit within the second infant nesting region INR2 because it is larger than the first infant nesting region INR1, there is a desire to create a cozy and tight space for the newborn infant. This is because the newborn infant is used to being in a tight space based on his/her time in the womb. Thus, creating a small, snug space (i.e., the first infant nesting region INR1) by using the second bumper assembly 160 may be desirable when using the apparatus 100 with a newborn infant because it may make the newborn infant more comfortable. As the child grows, various pillows of the second bumper assembly 160 may be removed to create a larger space for the infant to lay in. This adds to the versatility of the apparatus 100 because it enables the apparatus 100 to grow with the child. Many apparatuses currently available are only useful for the first few months of the infant's life because the infant outgrows it at that point. Because each of the pillows is independently couplable to the base 110, the apparatus 100 described herein can be used for at least the first year of the infant's life, if not longer.

Figure 11:
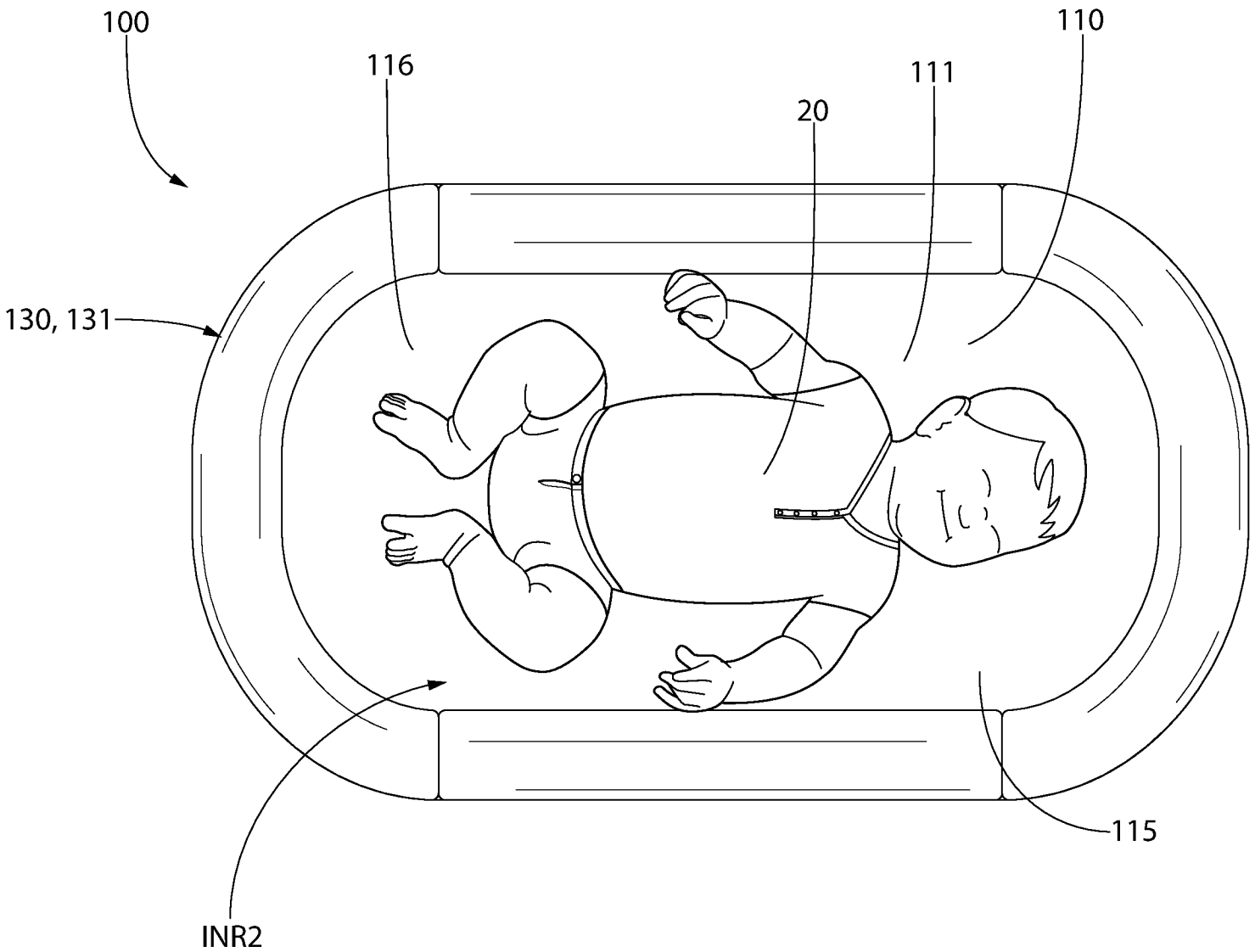
FIG. 11 is a front view of the convertible infant support apparatus with the first bumper assemblies attached to the base and an infant resting on the base surrounded by the first bumper assembly.

FIG. 11 illustrates the apparatus 100 with the first and second bumper assemblies 130, 160 in the second state just like in FIG. 4B, except that in FIG. 11 an infant 20 is located within the second infant nesting region INR2, which is equivalent to the combination of the intermediate portion 115 and the central portion 116 of the front surface 111 of the base 110. The infant 20 is larger than the infant 10, but as can be seen, there is plenty of space for the infant 20 in the second infant nesting region INR2. This is because the second infant nesting region INR2 has a greater area than the first infant nesting region INR1 because the second bumper assembly 160 is no longer coupled to the base 110. The infant 20 can sleep within the second infant nesting region INR2 with the first bumper assembly 130 in this state. Thus, the apparatus 100 can continue to be used even as the child grows.

One potential use for the apparatus 100 is to provide a space for the infant on the parent's bed in a co-sleeping arrangement. A major fear with co-sleeping is that the parent/caretaker might roll onto the infant, which could suffocate the child. With the apparatus 100 described herein, the apparatus 100 can be placed on the caretaker's bed with the infant in the nesting area. The caretaker can feel confident that he/she will not roll over onto the baby because the first and/or second bumper assemblies 130, 160 will prevent the caretaker from doing so. The first and/or second bumper assemblies 130, 160, when coupled to the base 110, provide a safe, snuggled environment for the infant. The apparatus 100 could also be placed on a separate structure placed next to the parent's bed in a room-sharing situation while still providing benefits by enabling the feeding parent to seamlessly transition the infant from sleeping to feeding and back to sleeping.

Figure 4C:
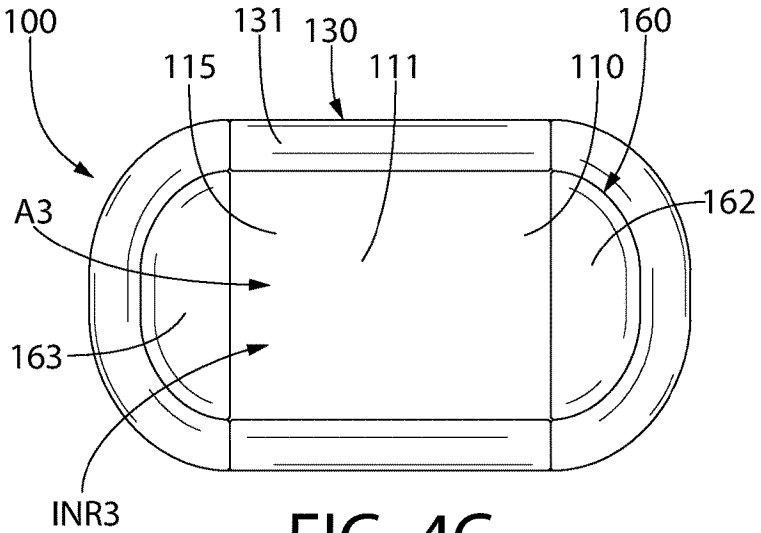

FIG. 4C illustrates a third configuration (or a third state of the first and second bumper assemblies 130, 160) whereby the first plurality of pillows 131 of the first bumper assembly 130 are all coupled to the base 110 along the perimeter portion 114 of the front surface 111 of the base 110 and a portion of the second bumper assembly 160 (i.e., some but not all of the pillows of the second plurality of pillows 161)

is coupled to the base 110 along the intermediate portion 115 of the front surface 111 of the base 110. In FIG. 4C, the first and second end pillows 162, 163 of the second plurality of pillows 161 are coupled to the base 110 and the first and second side pillows 164, 165 are detached from the base 110. In this state, the first and second bumper portions 130, 160 define a third infant nesting region INR3 having a third area A3. The third area A3 is less than the second area A2 and greater than the first area A1. This configuration may be best suited for an infant between three and six months old depending on the size of the infant. Although the third infant nesting region INR3 is associated with the configuration of FIG. 4C in the exemplified embodiment, the third infant nesting region INR3 can be associated with any configuration that includes all of the pillows of the first bumper assembly 130 coupled to the base 110 and one or more of the pillows of the second bumper assembly 160 coupled to the base 110.

Figure 4D:
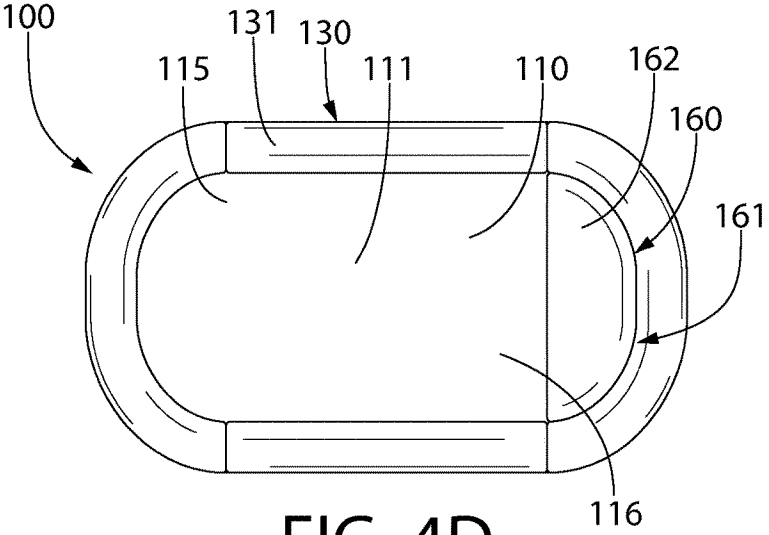

FIG. 4D illustrates still another configuration whereby the entire first bumper assembly 130 is coupled to the base 110, but only the first end pillow 162 of the second bumper assembly 160 is coupled to the base 110. Thus, the second end pillow 163 and the first and second side pillows 164, 165 of the second bumper assembly 160 are not coupled to the base 110. Thus, FIG. 4D illustrates a variation whereby the first bumper assembly 130 may be coupled to the base 110 in its entirety and any of one or more of the second plurality of pillows 161 of the second bumper assembly 160 may be coupled to the base 110.

Figure 4F:
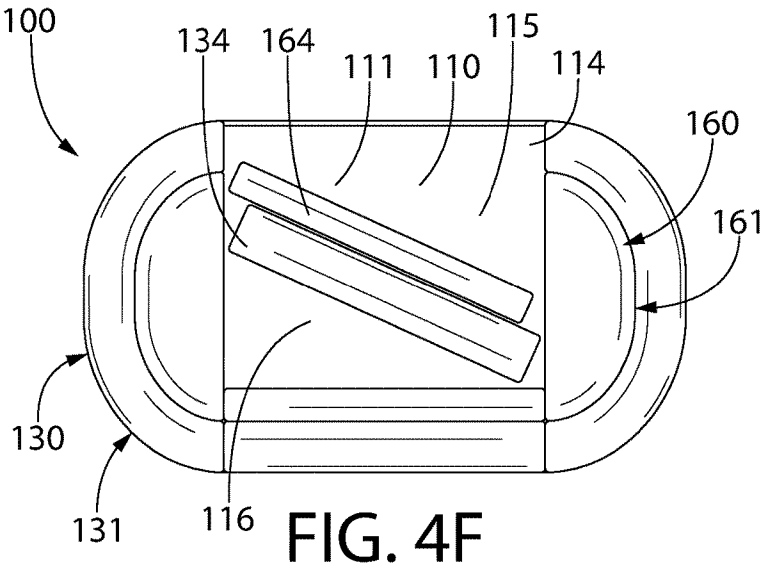
Figure 4H:
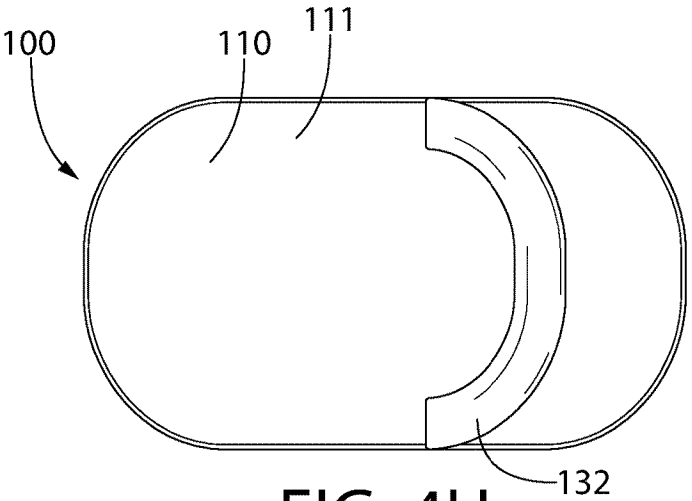
Figure 4E:
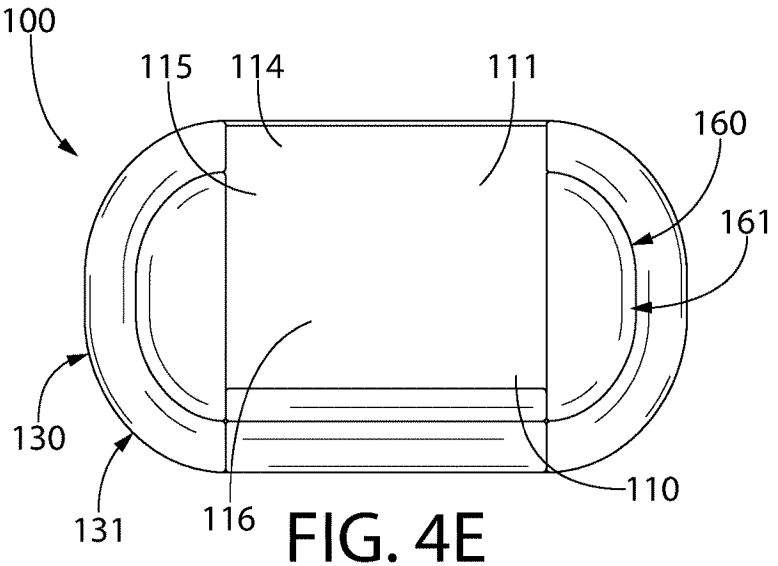

FIG. 4E illustrates still another configuration whereby all of the pillows of the first and second pluralities of pillows 131, 161 of the first and second bumper assemblies 130, 160 are coupled to the base 110 except for the first linear side pillows 134, 164. Again, the remaining pillows of the first and second bumper assemblies 130, 160 are positioned in the same location as discussed above with the pillows of the first bumper assembly 130 located along the perimeter portion 114 of the front surface 111 of the base 110 and the pillows of the second bumper assembly 160 located along the intermediate portion 115 of the front surface 111 of the base 110. This configuration may be best used for a nesting position.

FIG. 4F illustrates still another configuration that is similar to the configuration of FIG. 4E, except in this configuration the first linear side pillows 134, 164 of the first and second bumper assemblies 130, 160 are coupled to the base 110, but not along the perimeter and intermediate portions 114, 115. Rather, the first and second linear side pillows 134, 164 are coupled to the front surface 111 of the base 110 so as to extend across the central portion 116 of the front surface 111 of the base 110. This is possible because, as described above, the entirety of the front surface 111 of the base 110, including the perimeter portion 114, the intermediate portion 115, and the central portion 116, are formed of a loop fabric. Thus, the pillows of the first and second bumper assemblies 130, 160 can be positioned anywhere along the front surface 111 of the base 110, including along the central portion 116 thereof. The configuration depicted in FIG. 4F may be particularly suited for laid-back breastfeeding position, also known as "biological nursing."

Figure 4G:
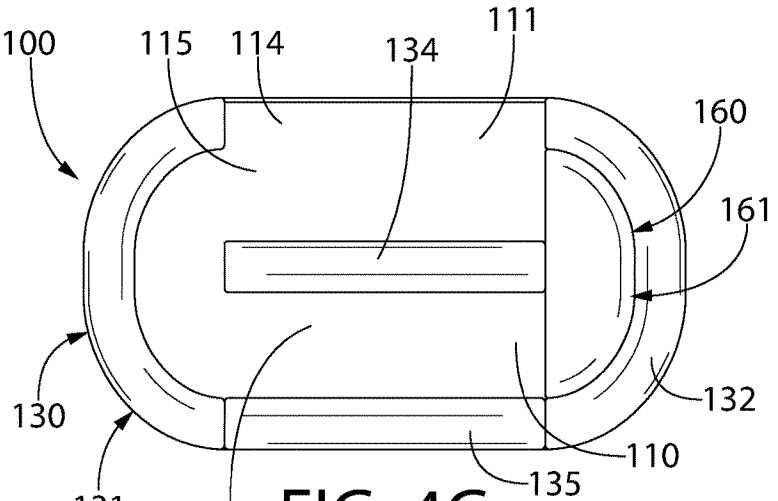

FIG. 4G illustrates still another configuration whereby the first bumper assembly 130 is coupled to the base 110 and only the first end pillow 162 is coupled to the base 110 within the intermediate portion 115 of the front surface 111 of the base 110. In FIG. 4G, the first and second arcuate end pillows 132, 133 and the second linear side pillow 135 of the first plurality of pillows 131 of the first bumper assembly 130 are located within the perimeter portion 114 and the first linear side pillow 134 is located within the central portion 116. This configuration may be particularly suited for a side-lying breastfeeding position.

FIG. 4H illustrates still another configuration whereby the only pillow attached to the base 110 is the first arcuate end pillow 132 of the first plurality of pillows 131 of the first bumper assembly 130. However, the first arcuate end pillow 132 is not located only within the perimeter portion 114 of the front surface 111 of the base 110, but rather it extends across the central portion 116 of the front surface 111 of the base 110. With the apparatus 100 in this configuration, the apparatus 100 may be suited for tummy time for the child. One or more of the linear side pillows 134, 135, 164, 165 may also be coupled to the base 110 to prevent the infant from rolling over during tummy time, which is a common occurrence for an infant that does not enjoy tummy time. Thus, the apparatus 100 is not only suitable for sleeping and nursing, but can also be used as an infant activity mat.

Thus, FIGS. 4A-4H illustrate some of the versatility of the apparatus 100. It should be appreciated from viewing FIGS. 4A-4H that each of the pillows of the first and second pluralities of pillows 131, 161 of the first and second bumper assemblies 130, 160 can be positioned at any location along the front surface 111 of the base 110 as may be desired for a particular infant activity, whether it be an awake activity, sleeping, or nursing. Thus, the apparatus 100 is an all-in-one type device. Furthermore, the apparatus 100 is portable, as described more fully below, and can thus be used instead of a playpen (such as the Pack 'N Play® or similar), which is much larger and more difficult to transport from place to place.

In still other embodiments, any of one or more of the pillows may be coupled to the base 110 in a configuration such that a portion of the pillow overlies the base 110 and another portion of the pillow protrudes from the base 110. Thus, the pillows do not need to be positioned so that an entirety of the pillow is aligned with the base 110. Rather, so long as a portion of the pillow that has the hook fastener on its bottom surface is aligned with the base 110 to detachably couple the pillow to the base 110 (via interaction between the hook fastener and the loop fabric of the front surface 111 of the base 110), a portion of the pillow can extend beyond the outer edge 113 of the base 110. Thus, the various configurations for the pillows on the base 110 is virtually endless.

Figure 5:
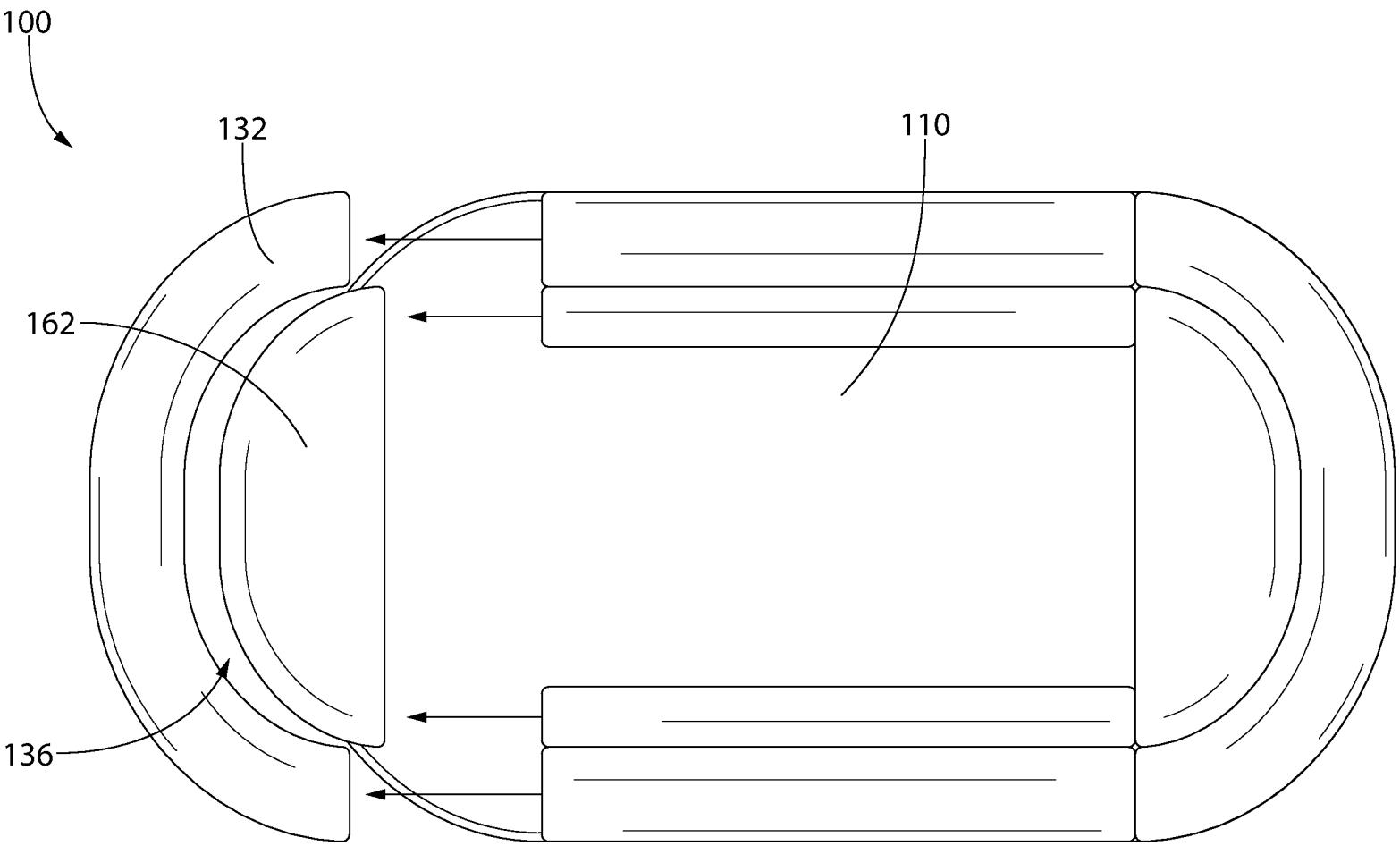
FIG. 5 is a front view of the convertible infant support apparatus illustrating portions of each of the first and second bumper assemblies being detached from the base.
Figure 6B:
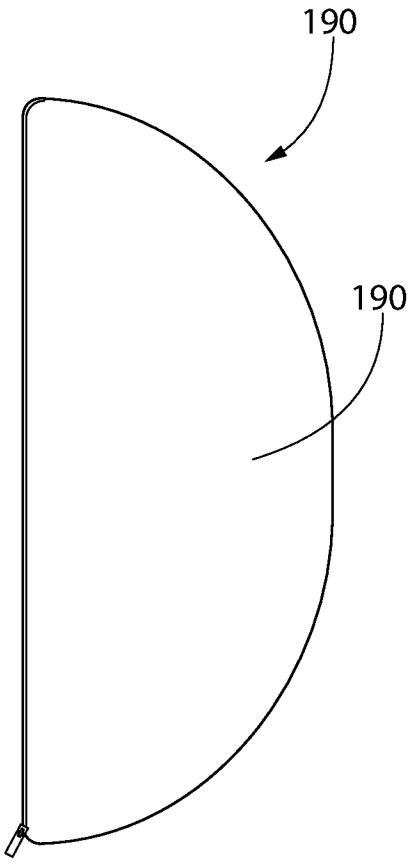
FIG. 6B illustrates the portions of the first and second bumper assemblies of FIG. 5 fully positioned within the pillow case to form a nursing pillow.

Referring to FIGS. 5-6B, the use of a portion of the apparatus 100 to form a nursing pillow will be described. FIG. 5 illustrates the apparatus 100 with both of the first and second bumper assemblies 130, 160 positioned in their closed geometric shape arrangements and with the first arcuate end pillow 132 of the first bumper assembly 130 and the first end pillow 162 of the second bumper assembly 160 being detached from the base 110.

Figure 6A:
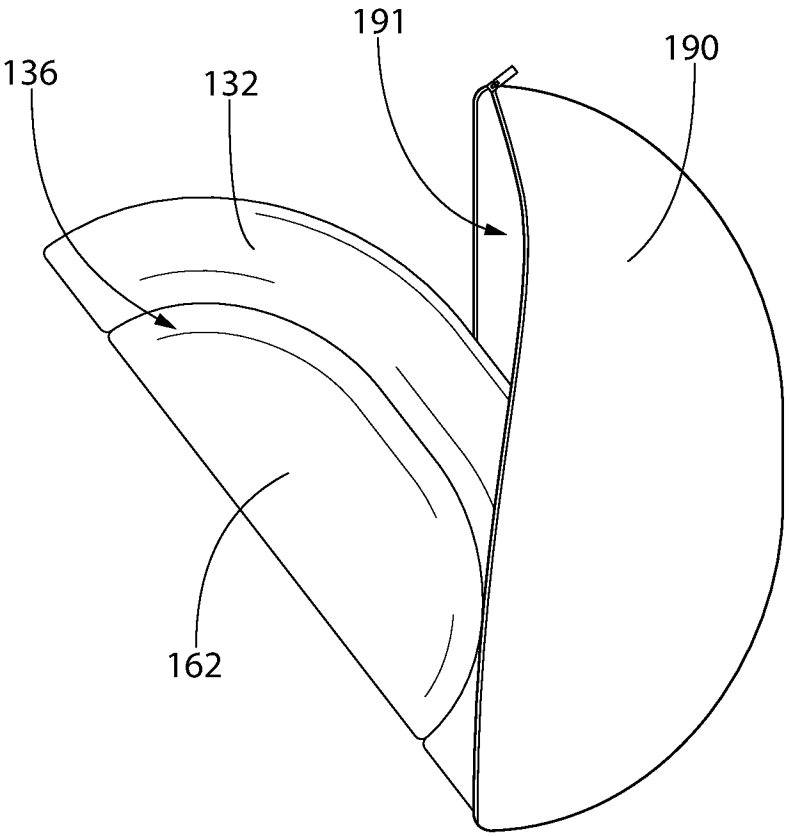
FIG. 6A illustrates the portions of the first and second bumper assemblies of FIG. 5 being placed within a pillow case.

Next, referring to FIG. 6A, a pillow case 190 is illustrated. The pillow case 190 has an interior cavity 191 that is configured to hold the first arcuate end pillow 132 and the first end pillow 162. Thus, as illustrated in FIG. 6B, the first arcuate end pillow 132 and the first end pillow 162 are placed in the interior cavity 191 of the pillow case 190. Specifically, the first end pillow 162 is placed within the nesting region 136 of the first arcuate end pillow 132 to form a D-shaped pillow, and this D-shaped pillow is collectively placed into the interior cavity 191 of the pillow case 190. As shown in FIG. 6B, this thereby forms a nursing pillow 192 that can be placed on a nursing mother's lap to support the infant during nursing.

Figure 7A:
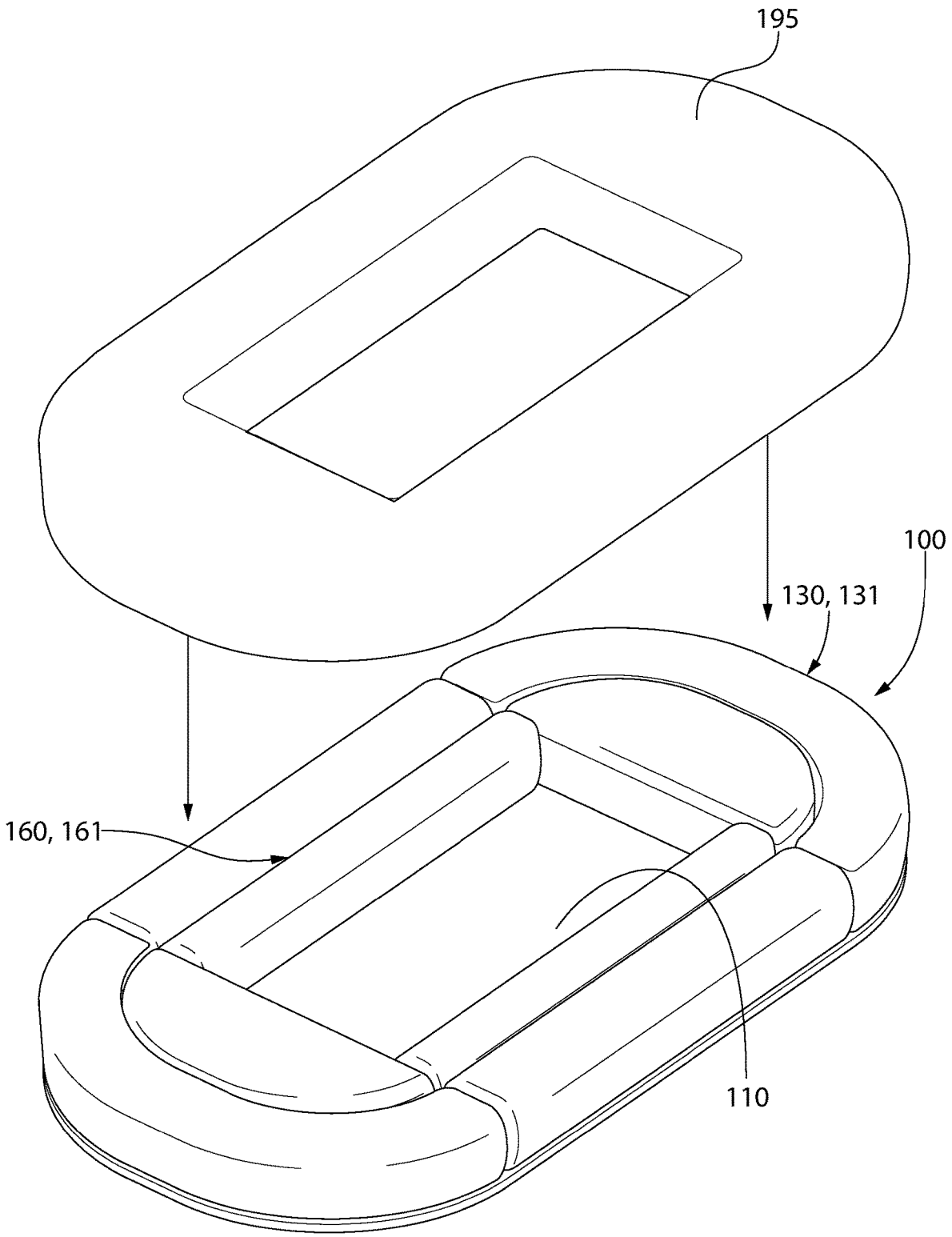
FIG. 7A illustrates a cover being placed over the first and second bumper assemblies while they are coupled to the base.
Figure 7B:
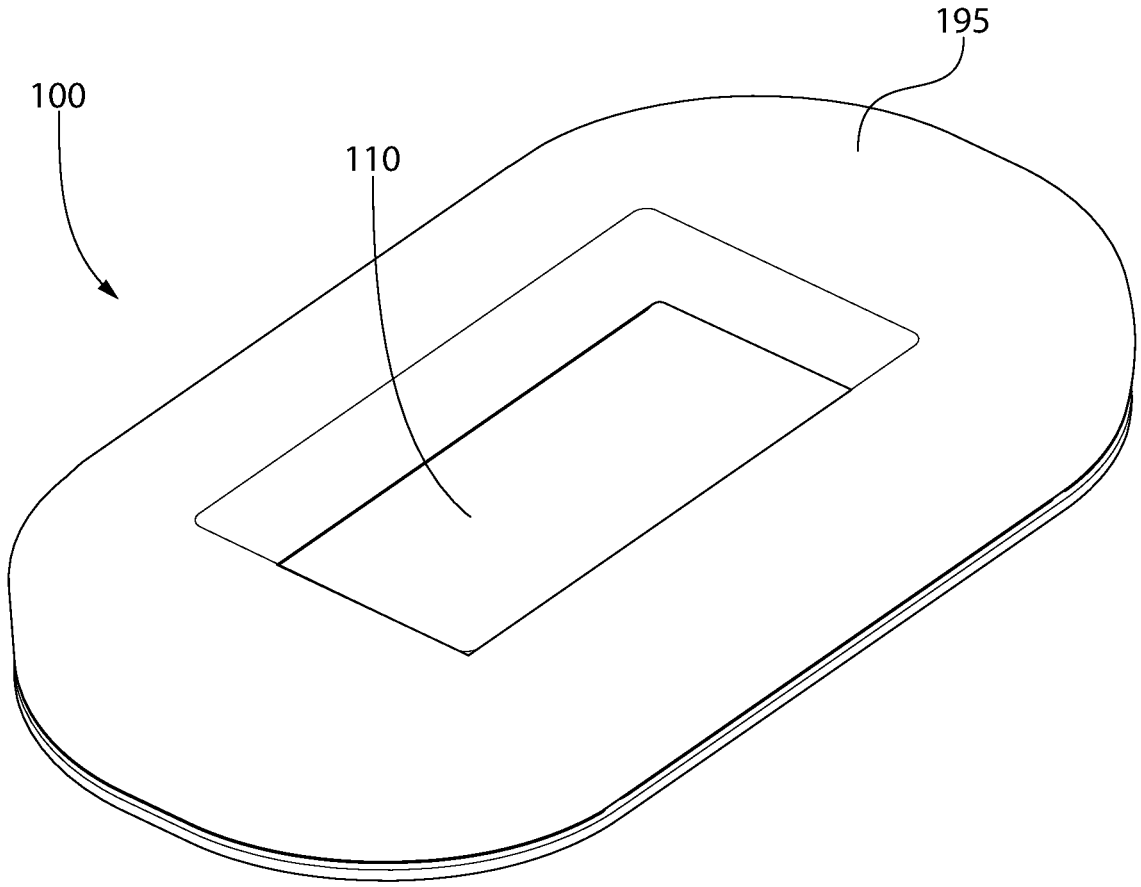
FIG. 7B illustrates the convertible infant support apparatus with the cover covering the first and second bumper assemblies.

Referring to FIGS. 7A and 7B, the apparatus 100 is illustrated whereby a bumper cover 195 is being placed over the first and second bumper assemblies 130, 160. In FIGS. 7A and 7B, this is done while the first and second bumper assemblies 130, 160 are coupled to the base 110, but the bumper cover 195 could be placed over the first and second bumper assemblies 130, 160 first and then they could be coupled to the base 110. The bumper cover 195 provides a more seamless appearance so that the individual pillows of the first and second bumper assemblies 130, 160 are not visible, but rather only the bumper cover 195 is visible. An additional bumper cover may be provided to fit over any configuration of the pillows on the base 110.

In some embodiments, the first and second bumper assemblies 130, 160 may be a first color and the front surface 111 of the base 110 may be a second color that is different than the first color. Of course, the invention is not to be so limited and in other embodiments the first and second colors may be the same. Furthermore, the pillows of the first and second bumper assemblies 130, 160 may have different colors from each other. Moreover, in some embodiments the front surface 111 of the base 110 and the rear surface 112 of the base 110 may be different colors. The colors that can be used for the first and second bumper members 130, 160 and/or the base 110 include, without limitation, a neutral white, red, blue, green, gray, and any other colors. Furthermore, portions of or the entirety of the apparatus 100 (i.e., just the base 110, just the first and/or second bumper assemblies 130, 160, or both the base 110 and the first and second bumper assemblies 130, 160) may comprise glow-in-the-dark materials. Glow-in-the-dark material may be beneficial so that a mother can transition a baby from a sleeping position to a nursing position during the nighttime without having to turn the light Specifically, the apparatus 100 may be configured to glow-in-the-dark so that an adult user can see exactly where the baby is without disturbing the baby's sleep by turning on a light.

Figure 8:
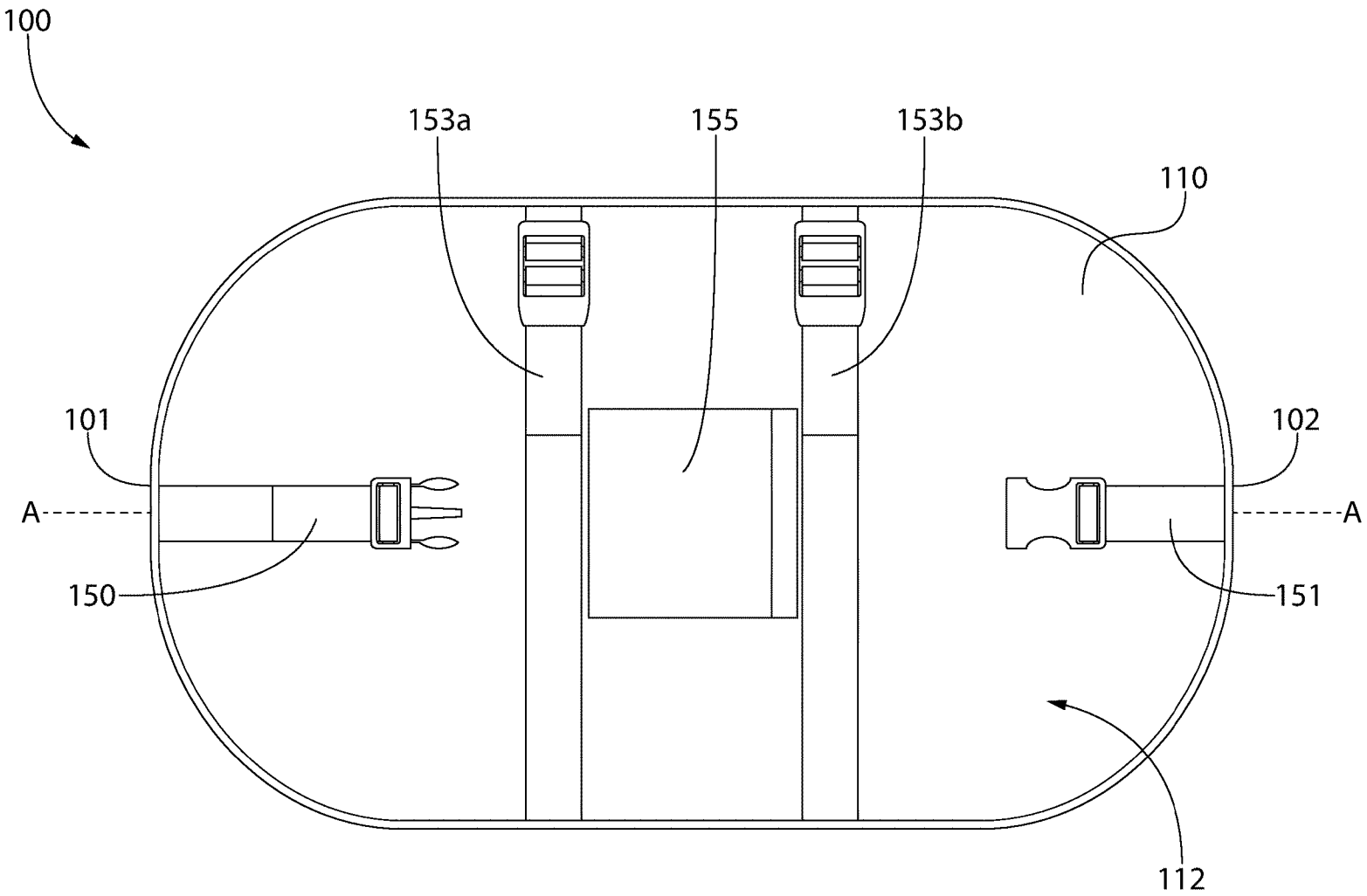
FIG. 8 is a rear view of the convertible infant support apparatus of FIG. 1 in an unfolded state.
Figure 9:
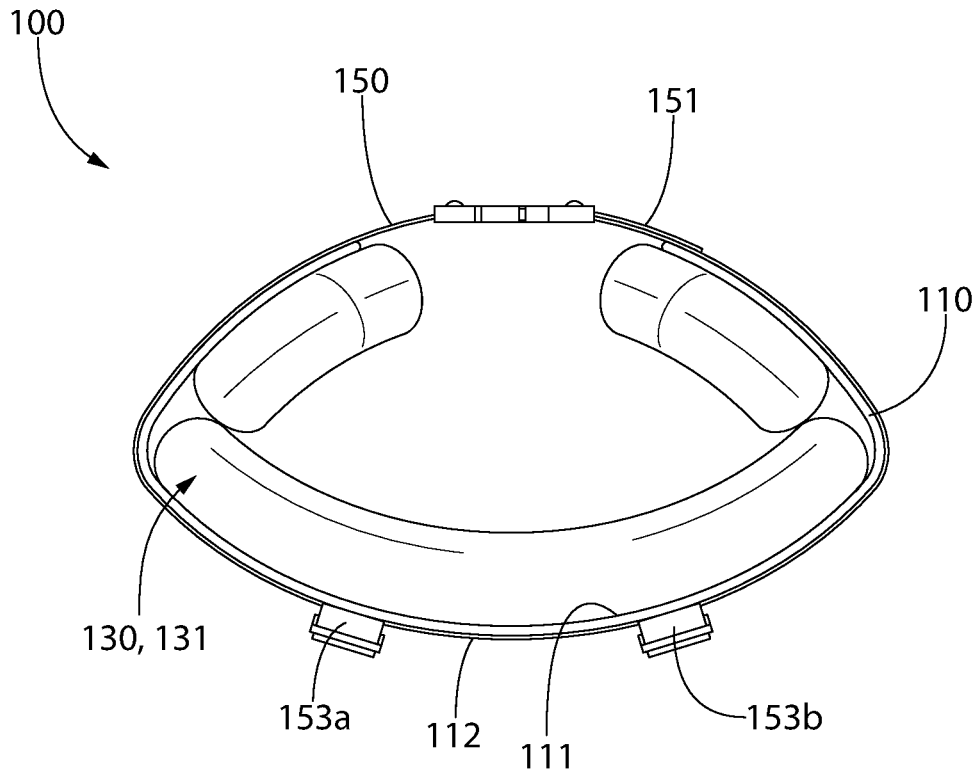
FIG. 9 is a side view of the convertible infant support apparatus in a folded state.

Referring to FIGS. 8 and 9, the apparatus 100 will be further described. FIG. 8 illustrates the rear surface 112 of the base 110 of the apparatus 100. The apparatus 100 comprises a first fastening member 150 coupled to the first end 101 of the base 110 and a second fastening member 151 coupled to the second end 102 of the base 110. In the exemplified embodiment, the first and second fastening members 150, 151 collectively form a buckle such that the first fastening member 150 comprises a male buckle member and the second fastening member 151 comprises a female buckle member.

The apparatus 100 is alterable between an unfolded state, illustrated in FIG. 8, wherein the front and rear surfaces 111, 112 of the base 110 are substantially planar, and a folded state, illustrated in FIG. 9, in which the first and second bumper assemblies 130, 160 are at least partially enclosed within the base 110. To transition from the unfolded state to the folded state, the first and second ends 101, 102 of the base 110 are pulled towards one another with the first and second fastening members 150, 151 located on the front surface 111 side of the base 110 (rather than on the rear surface 112 side of the base 110). In the folded state, the rear surface 112 of the base 110 forms the outer surface of the apparatus 100 such that the apparatus 100 is folded inwardly about the front surface 111. The apparatus 100 can be transitioned into the folded state while the first and second bumper assemblies 130, 160 are coupled to the base 110 on the perimeter and intermediate portions 114, 115 of the front surface 111 of the base 110, respectively. When in the folded state, the first and second fastening members 150, 151 can be coupled together to lock or otherwise maintain the apparatus 100 in the folded state. The first and second fastening members 150, 151 can be repetitively coupled and decoupled (i.e., locked and unlocked) to transition the apparatus 100 between the folded and unfolded states as should be readily understood by persons skilled in the art.

Although male and female buckles are used in the exemplified embodiment as the first and second fastening members 150, 151, the invention is not to be so limited and other connection mechanisms can be used. For example, straps with hook and loop members, buttons, snaps, adhesive, or the like can replace the male and female buckles in alternative embodiments. Any type of connection member that facilitates maintaining the apparatus 100 in the folded state as illustrated may be used in alternative embodiments.

The apparatus 100 further comprises a pair of straps 153*a*, 153*b* on the rear surface 112 of the base 110. The pair of straps 153*a*, 153*b* may have an adjustable length similar to the straps of a backpack. The pair of straps 153*a*, 153*b* are attached to the rear surface 112 of the base 110 at two spaced apart locations, the remainder of the pair of straps 153*a*, 153*b* not being connected directly to the base 110. The pair of straps 153*a*, 153*b* each extend in a direction transverse to the axis A-A of the base 110. Thus, a user can wear the apparatus 100 on his/her back like a backpack by inserting his/her arms through the pair of straps 153*a*, 153*b*. It may in some embodiments be preferable to first alter the apparatus 100 into the folded state and to then place the apparatus 100 on the user's back for transport so that the apparatus 100 does not extend too far past the wearer's body. Thus, the pair of straps 153*a*, 153*b* makes the apparatus 100 readily and easily portable. The apparatus 100 can therefore easily function as a traveling bassinet or sleeping apparatus for an infant.

Furthermore, the apparatus 100 may include a pocket 155 on the rear surface 112 of the base 110. In the exemplified embodiment, the pocket 155 is located between the two straps of the pair of straps 153*a*, 153*b*. However, the pocket 155 could be positioned at any location along the rear surface 112 of the base 110. Furthermore, more than one pocket may be included in alternative embodiments. The pocket 155 may be suitable for storing a pacifier or other infant soothing device or it may be larger so that it can store diapers, wipes, and/or other infant necessities.

As noted above, the front surface 111 of the base 110 may be formed of a loop fabric. The other components, specifically each of the pillows of the first and second bumper assemblies 130, 160 and the rear surface 112 of the base 110, may in some embodiments be formed of Dintex fabric, which is waterproof, windproof, stainproof, and breathable. The fabric that forms the aforementioned components may comprise an outer layer that is 94% polyester and 6% spandex, a middle layer that is 100% polyurethane, and an inner layer that is 100% polyester. Of course, the Dintex fabric is merely one possibility and the invention is not to be limited by this. Thus, in other embodiments the pillows of the first and second bumper assemblies 130, 160 and the rear surface 112 of the base 110 may be formed of any desired fabric material, including cotton, flax, wool, silk, denim, leather, nylon, polyester, spandex, combinations thereof, or the like. Thus, the invention is not to be limited by the material used to form the various components of the apparatus 100 unless so specified in the claims.

Although described herein as an infant support apparatus, the invention is not to be limited as only capable of use by human infants. Rather, the apparatus described herein may be used for domestic animals such as dogs or the like so that the apparatus can function as a dog bed that gets larger as the dog grows. For example, both sets of bumpers may be coupled to the base for a puppy to create a smaller sleeping area for the puppy, but as the puppy grows and becomes a dog, the inner set of bumpers may be removed to create a larger sleeping area for the dog. Of course, a dog is only one example of an animal that may use the apparatus described herein and in some embodiments the apparatus may be a convertible support apparatus for growing mammals without being limited to a particular type/species of mammal. Moreover, although two bumper assemblies are shown and described, in other embodiments additional bumper assemblies may be used to provide an even greater degree of growth for the user.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. A convertible infant support apparatus comprising:

a base having a front surface and a rear surface opposite the front surface, the front surface of the base having a perimeter portion, an intermediate portion, and a central portion, the perimeter portion surrounding the intermediate portion and the intermediate portion surrounding the central portion;

a first bumper assembly detachably coupled to the base along the perimeter portion of the front surface of the base, the first bumper assembly defining a first closed geometric shape;

a second bumper assembly detachably coupled to the base along the intermediate portion of the front surface of the base, the second bumper assembly defining a second closed geometric shape;

wherein the first bumper assembly surrounds the second bumper assembly and the second bumper assembly surrounds the central portion of the front surface of the base; and wherein the first and second bumper assemblies are alterable between: (1) a first state in which the first and second bumper assemblies are coupled to the base to define a first infant nesting region having a first area; (2) a second state in which the first bumper assembly is coupled to the base and the second bumper assembly is not coupled to the base to define a second infant nesting region having a second area, wherein the second area is greater area than the first area; and (3) a third state in which an entirety of the first bumper assembly is coupled to the base and a portion of the second bumper assembly is coupled to the base to define a third infant nesting region having a third area, wherein the third area is greater than the first area and less than the second area.

2. The convertible infant support apparatus according to claim 1 wherein the first bumper assembly comprises a first plurality of pillows that are positioned end-to-end to form the first closed geometric shape, and wherein the second bumper assembly comprises a second plurality of pillows that are positioned end-to-end to form the second closed geometric shape.

3. The convertible infant support apparatus according to claim 2 wherein each of the pillows of the first and second pluralities of pillows is detachable from the base independently of each of the other pillows of the first and second pluralities of pillows.

4. The convertible infant support apparatus according to claim 2 wherein each of the pillows of the first plurality of pillows is attached to the base but not to each other, and wherein each of the pillows of the second plurality of pillows is attached to the base but not to each other.

5. The convertible infant support apparatus according to claim 2 wherein the first plurality of pillows comprises two arcuate end pillows and two linear side pillows and wherein the second plurality of pillows comprises two end pillows and two linear side pillows, and wherein each of the end pillows of the second plurality of pillows nests within one of the arcuate end pillows of the first plurality of pillows.

6. The convertible infant support apparatus according to claim 5 further comprising a pillow case having an interior cavity configured to hold one of the arcuate end pillows of the first plurality of pillows and one of the end pillows of the second plurality of pillows to form a nursing pillow.

7. The convertible infant support apparatus according to claim 1 wherein the front surface of the base is formed from a loop fabric and wherein each of the first and second bumper assemblies comprises a hook fastener that engages the loop fabric to couple the first and second bumper assemblies to the front surface of the base.

8. The convertible infant support apparatus according to claim 1 wherein, with the first and second bumper assemblies coupled to the perimeter and intermediate portions of the base, respectively, the apparatus is alterable between: (1) an unfolded state in which the front and rear surfaces of the base are substantially planar; and (2) a folded state in which the first and second bumper assemblies are at least partially enclosed within the base, and further comprising first and second fastening members for maintaining the apparatus in the folded state.

9. The convertible infant support apparatus according to claim 1 further comprising first and second straps coupled to the base and positioned on the rear surface of the base to enable the apparatus to be worn on a user's back.

10. A convertible infant support apparatus comprising:

a base having a front surface and a rear surface opposite the front surface, the front surface of the base having a perimeter portion, an intermediate portion, and a central portion, the perimeter portion surrounding the intermediate portion and the intermediate portion surrounding the central portion;

a first bumper assembly detachably coupled to the base along the perimeter portion of the front surface of the base, the first bumper assembly defining a first closed geometric shape;

a second bumper assembly detachably coupled to the base along the intermediate portion of the front surface of the base, the second bumper assembly defining a second closed geometric shape;

wherein the first bumper assembly surrounds the second bumper assembly and the second bumper assembly surrounds the central portion of the front surface of the base; and wherein an inner surface of the first bumper assembly defines a first shape and an inner surface of the second bumper assembly defines a second shape, the first and second shapes being different.

11. A convertible infant support apparatus comprising:

a base having a front surface and a rear surface opposite the front surface, the front surface of the base having a central portion and a perimeter portion that surrounds the central portion;

a first plurality of pillows that are detachably coupled to the base independently from one another so that the first plurality of pillows can be coupled to the base in a first plurality of different configurations, each of the pillows of the first plurality of pillows comprising a hook fastener for detachably coupling the pillows to the front surface of the base;

wherein the first plurality of different configurations comprises a first configuration in which the first plurality of pillows are located along the perimeter portion of the front surface of the base and define a first closed geometric shape that surrounds the central portion of the front surface of the base; and wherein an entirety of the front surface of the base is formed from a loop fabric so that each of the pillows of the first plurality of pillows can be coupled to the front surface of the base at any location along the front surface of the base.

12. The convertible infant support apparatus according to claim 11 wherein the first plurality of different configurations comprises a second configuration in which at least one of the pillows of the first plurality of pillows is coupled to the base along the central portion of the front surface of the base.

13. The convertible infant support apparatus according to claim 11 further comprising:

the front surface of the base comprising an intermediate portion that surrounds the central portion and is surrounded by the perimeter portion; and a second plurality of pillows that are detachably coupled to the base independently from one another so that the second plurality of pillows can be coupled to the base in a second plurality of different configurations, each of the pillows of the second plurality of pillows comprising a hook fastener for detachably coupling the pillows to the front surface of the base, and wherein the second plurality of different configurations comprises a first configuration in which the second plurality of pillows are located along the intermediate portion of the front surface of the base and define a second closed geometric shape that surrounds the central portion of the front surface of the base.

14. The convertible infant support apparatus according to claim 13 wherein the first closed geometric shape formed by the first plurality of pillows surrounds the second closed geometric shape formed by the second plurality of pillows.

* * * * *